US012005334B1

(12) United States Patent
Cochran et al.

(10) Patent No.: US 12,005,334 B1
(45) Date of Patent: Jun. 11, 2024

(54) DRIBBLE TRAINING SYSTEM AND METHOD OF USE

(71) Applicant: DribbleTEK, Inc., Hendersonville, TN (US)

(72) Inventors: Brandon Kyle Cochran, Franklin, TN (US); Alden Lee Cochran, Hendersonville, TN (US); Alexander Naresh Raj, Los Osos, CA (US); Martin John Hughes, Camarillo, CA (US)

(73) Assignee: DribbleTEK, Inc., Hendersonville, TN (US)

( * ) Notice: Subject to any disclaimer, the term of this patent is extended or adjusted under 35 U.S.C. 154(b) by 215 days.

(21) Appl. No.: 17/700,351

(22) Filed: Mar. 21, 2022

(51) Int. Cl.
*A63B 69/00* (2006.01)
*A63B 71/02* (2006.01)
*A63B 71/06* (2006.01)

(52) U.S. Cl.
CPC ..... *A63B 69/0071* (2013.01); *A63B 71/03* (2020.08); *A63B 71/0622* (2013.01); *A63B 2071/0625* (2013.01); *A63B 2210/50* (2013.01); *A63B 2214/00* (2020.08); *A63B 2225/50* (2013.01); *A63B 2225/74* (2020.08)

(58) Field of Classification Search
CPC . A63B 69/0071; A63B 71/03; A63B 71/0622; A63B 2071/0625; A63B 2210/50; A63B 2214/00; A63B 2225/50; A63B 2225/74
USPC ..... 473/422, 415
See application file for complete search history.

(56) References Cited

U.S. PATENT DOCUMENTS 4,627,620 A * 12/1986 Yang ..... A63B 69/0028 482/84
4,645,458 A * 2/1987 Williams ..... A63B 69/0053 482/901
5,271,627 A * 12/1993 Russell ..... A63B 69/0053 482/84

(Continued)

OTHER PUBLICATIONS

Ball Amazingly (ballamazingly.com) web page article entitled "Top 21 Basketball Dribbling Drills to Improve Ball Handling" at https://ballamazingly.com/top-basketball-dribbling-drills/#:~:text=Top%2021%20Basketball%20Dribbling%20Drills%20to%20Improve%20Ball,Crossover%20Behind%20The%20Back%20Dribble%20Drill.%20More%20items accessed on Mar. 13, 2023.

(Continued)

*Primary Examiner* — Michael C Grant
(74) *Attorney, Agent, or Firm* — Master Key IP, LLP; Jeromye V. Sartain

(57) ABSTRACT

A dribble training system and method of use has a base unit having a plurality of cone indicator lights and a plurality of cone units each having a cone body and a button operably installed on the cone body, whereby the base unit is wirelessly paired with the plurality of cone units as by setting a base unit group address selection and a cone unit group address selection to be corresponding and further by setting a cone identifier unique to each cone unit, and further whereby selective illumination of a specific cone indicator light on the base unit followed by touching the button of the specific cone unit corresponding to the illuminated specific cone indicator light causes wireless transmission to the base unit of an activation signal corresponding to the touched button, resulting in cessation of the illumination of the specific cone indicator light.

20 Claims, 9 Drawing Sheets

(56) References Cited

U.S. PATENT DOCUMENTS

| | | | | |
|---|---|---|---|---|
| 5,669,833 | A * | 9/1997 | Stone | A63B 69/002 473/422 |
| 7,951,045 | B1 * | 5/2011 | Brader | A63B 71/06 482/3 |
| 8,002,283 | B1 * | 8/2011 | Jones | F41J 5/06 273/354 |
| 10,016,650 | B2 * | 7/2018 | Shaw | A63B 71/0622 |
| 10,532,260 | B2 * | 1/2020 | Del Monte | A63B 69/0026 |
| 2003/0114256 | A1 * | 6/2003 | Mathog | A63B 69/0053 473/422 |
| 2005/0288159 | A1 * | 12/2005 | Tackett | A63B 69/22 482/84 |
| 2011/0148039 | A1 * | 6/2011 | Klinnert | A63B 63/00 273/148 R |
| 2012/0081531 | A1 * | 4/2012 | DeAngelis | A63B 24/0021 348/77 |
| 2016/0038820 | A1 * | 2/2016 | Junaid | G09B 5/02 434/258 |
| 2016/0271448 | A1 * | 9/2016 | Edelhaeusser | G09B 19/0038 |
| 2017/0296894 | A1 * | 10/2017 | Min | A63B 71/0622 |
| 2018/0093160 | A1 * | 4/2018 | Alhadeff | A63B 71/023 |
| 2019/0374843 | A1 * | 12/2019 | Elder | A63B 69/002 |
| 2020/0179788 | A1 * | 6/2020 | Mazloompour | A63B 71/0622 |
| 2021/0008433 | A1 * | 1/2021 | Bush | A63B 67/002 |
| 2021/0220715 | A1 * | 7/2021 | Colding | H04L 67/306 |
| 2021/0260454 | A1 * | 8/2021 | Johnson | A63B 63/06 |
| 2021/0379456 | A1 * | 12/2021 | Mazloompour | A63B 63/00 |

OTHER PUBLICATIONS

DribbleUp (dribbleup.com) product web page entitled "Smart Basketball" at https://dribbleup.com/products/smart-basketball/default accessed on Mar. 13, 2023.

Elete Basketball (eletebasketball.com) web page at https://www.eletebasketball.com/ accessed on Mar. 13, 2023.

Optimum Basketball "Training for the Next Level" ("TheOptimumBasketball") YouTube video at https://www.youtube.com/watch?v=Ch_iAVLoXV8 dated May 31, 2011 and accessed on Jan. 13, 2024.

* cited by examiner

DRIBBLE TRAINING SYSTEM AND METHOD OF USE

BACKGROUND

The subject of this patent application relates generally to athletic or sports training, and more particularly to systems and methods configured for developing basketball dribbling and related skills.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, in a wide variety of sports and athletics, certain skills or abilities such as strength, stamina, reaction time, technique, posture, etc. and related mental aspects are essential to playing well and safely and to competing at a high level. And while to some extent all athletes have a degree of "natural" skill or ability, any such skills or abilities can be increased and honed or refined with regular beneficial training, whether through exercise and fitness efforts and sheer "hard work" or through coaching and training in order to be pushed and to receive helpful guidance on the "finer points" of technique that can make all the difference in forming good habits rather than bad ones and an athlete thereby reaching their full potential.

The sport of basketball is no exception to the variety of skills and abilities that benefit a player such as those mentioned above, but particularly including quickness, forward and backward and lateral explosiveness in movement, vertical leap, and of course strength and conditioning underlying all such activities, especially over time in the course of the virtually non-stop action of gameplay. Basketball players are known for and certainly benefit from being able to engage in such movements at a rapid and maintained pace.

Accordingly, in basketball coaching, training, and practicing, a wide array of drills and related equipment have been developed over the years in facilitating player development and enhancement of their basketball skills. Many such drills relate to the particular skill of dribbling, or the ability to keep the basketball bouncing while moving, without committing a violation ("carrying" or "palming" the ball or "double dribbling") or a turnover (losing the ball or having the ball stolen). The more refined a player's dribbling ability, the more likely the player can avoid defenders and get himself or herself in a better position for a shot or a pass to a teammate. And of course, all such dribbling activities must often be done at high speed with split-second decision-making about where the player's teammates and any opponents are on the court. As such, the more "connected" a player is with the ball and the more naturally he or she can dribble instinctively or without having to even look at the ball while bouncing it, and that with either hand, or the better "feel" a player has when dribbling, generally the better the player will be able to perform, particularly for guards and forwards that handle the ball more often during play and are to be "playmakers" or have the ability to "get their own shot." This degree of competency of course involves much practice to refine and make habitual proper dribbling techniques. Details relate to again being able to dribble the basketball effectively with either hand and also to keeping the ball low to reduce the chance of it being stolen, thus necessitating a low or somewhat hunched posture, particularly when in proximity to a defender, and yet even with such low-dribbling posture the player should be able to move quickly or explosively during gameplay with their head up rather than looking down at the ball so as to survey the court and plan his or her maneuver for a shot or pass, or simply put to be able to quickly react during the flow of the game to make the best play possible even while at all times maintaining a live dribble until ready to shoot or pass.

Dribbling drills designed to work on low and ambidextrous dribbling, whether stationary or moving, include various crossover dribble drills, pound dribble drills, pullback dribble drills, and behind the back dribble drills, often incorporating wall touches or other techniques to force a player to keep their head up and improve quickness or reaction time with either hand. And then such drills can be made more challenging by integrating them together or adding further elements and in any case by increasing their intensity or doing them as quickly as possible while maintaining control of the basketball. Equipment often included in such basketball dribbling drills other than one or more basketballs are cones or other obstacles to dribble around.

More recently, "smart basketball" technologies have been developed around the general idea of embedding a wireless transceiver within a ball so that it can be tracked spatially when wirelessly paired with a phone or tablet device running a related software app. The app can then facilitate various dribbling drills such as left-right movement or keeping the ball low while dribbling (not allowing the ball to come above a certain height while maintaining a live dribble), which drills can be done live with other players in a competitive context or through an on-demand library of classes. Examples of such "smart basketball" products are the DribbleUp® Smart Basketball by dribbleup, Inc. and the Elete Smart Ball by Fitivity. While these "smart basketball" technologies offer some high-tech and virtual coaching and dribbling training and improvement, they are still lacking in a number of respects, including not forcing a player to have his or her head up while dribbling and not facilitating forward or back or lateral movement but only stationary dribbling drills, thus not addressing critical training and skill development aspects that translate to real-world in-game skills.

Furthermore, such newer innovations specific to "smart basketballs" or the like and related equipment are thus more specific to the skill of dribbling and so not only often do not incorporate dynamic movement in such training but are thus not readily adapted to other strength and conditioning training, lateral movement or defensive training, etc. As such, known dribble training technologies simply lack versatility in terms of available training exercises, user interaction with the system and others, and adaptability or portability, depending on a number of factors.

What is still needed and has heretofore been unavailable is a comprehensive, versatile, and easy to use dribble training system and method of use wherein a base unit is wirelessly paired with multiple operable cone units and with an electronic device running a related software app for facilitating a variety of drills and games for improving a user's dribbling skills, hand quickness and hand-eye coordination, foot speed with proper offensive or defensive posture, and related mental and physical strength and stamina. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a new and improved dribble training system and method of use. In at least one embodiment, the dribble training system and method of use comprises a base unit having a plurality of cone indicator lights and a decoder configured to receive a two-digit base unit group address selection, and a plurality of cone units each having an encoder and an activate button switch, the encoder configured to receive a two-digit cone unit group address selection and a one-digit cone identifier and to transmit the cone unit group address selection and the cone identifier to the base unit, each cone unit further having a cone body and a button operably installed on the cone body and operably engaged with the activate button switch, whereby the base unit is wirelessly paired with the plurality of cone units as by setting the base unit group address selection and the cone unit group address selection to be corresponding and further by setting the cone identifier unique to each cone unit in the plurality of cone units, and further whereby selective illumination of a specific cone indicator light followed by activation of a specific activate button switch by touching the operably engaged button of the specific cone unit corresponding to the illuminated specific cone indicator light causes wireless transmission from the specific cone unit to the base unit of an activation signal corresponding to the activated specific activate button switch, resulting in cessation of the illumination of the specific cone indicator light.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
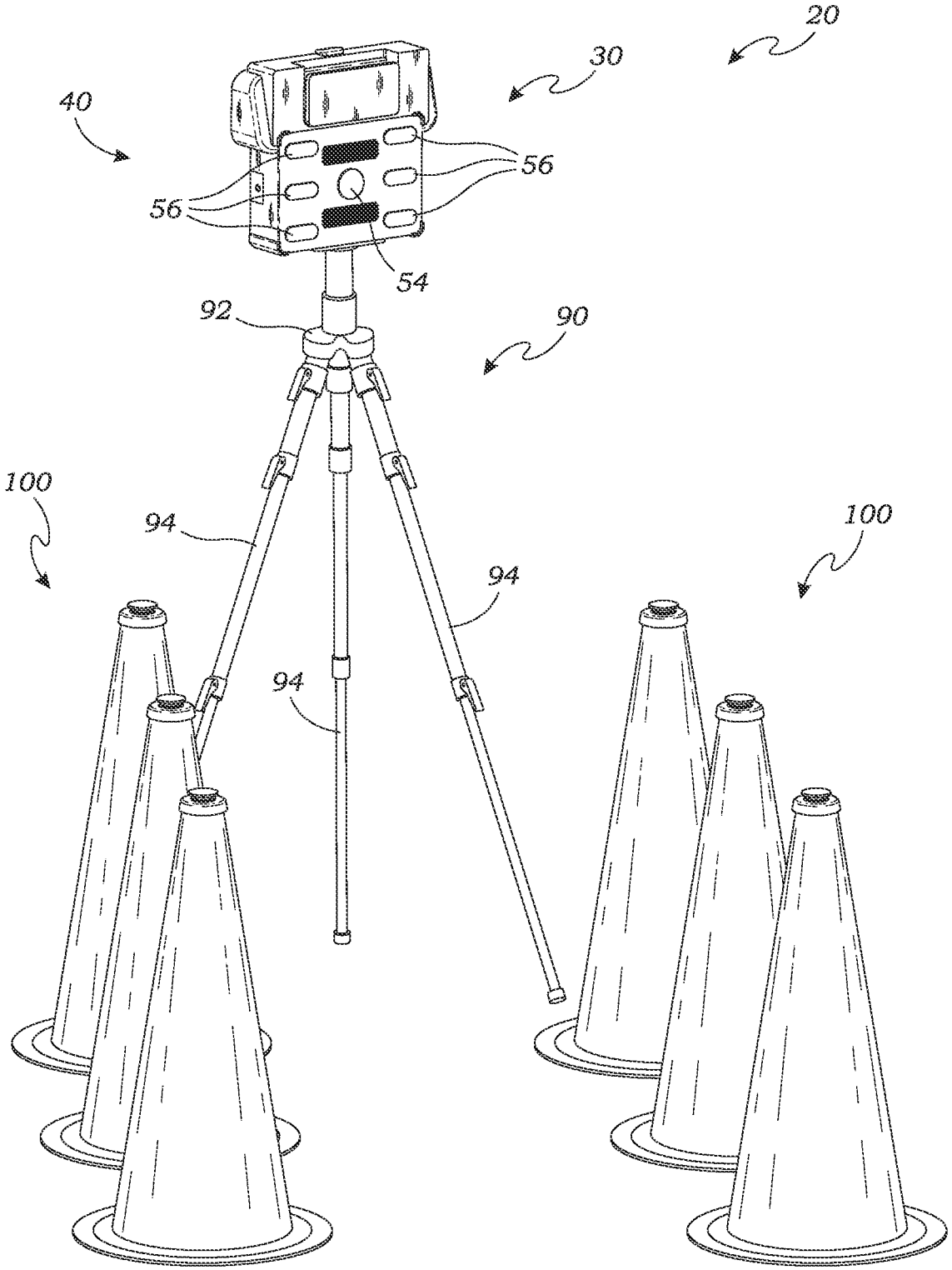
FIG. 1 is a perspective view of an exemplary dribble training system, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of a system or any related apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Figure 8:
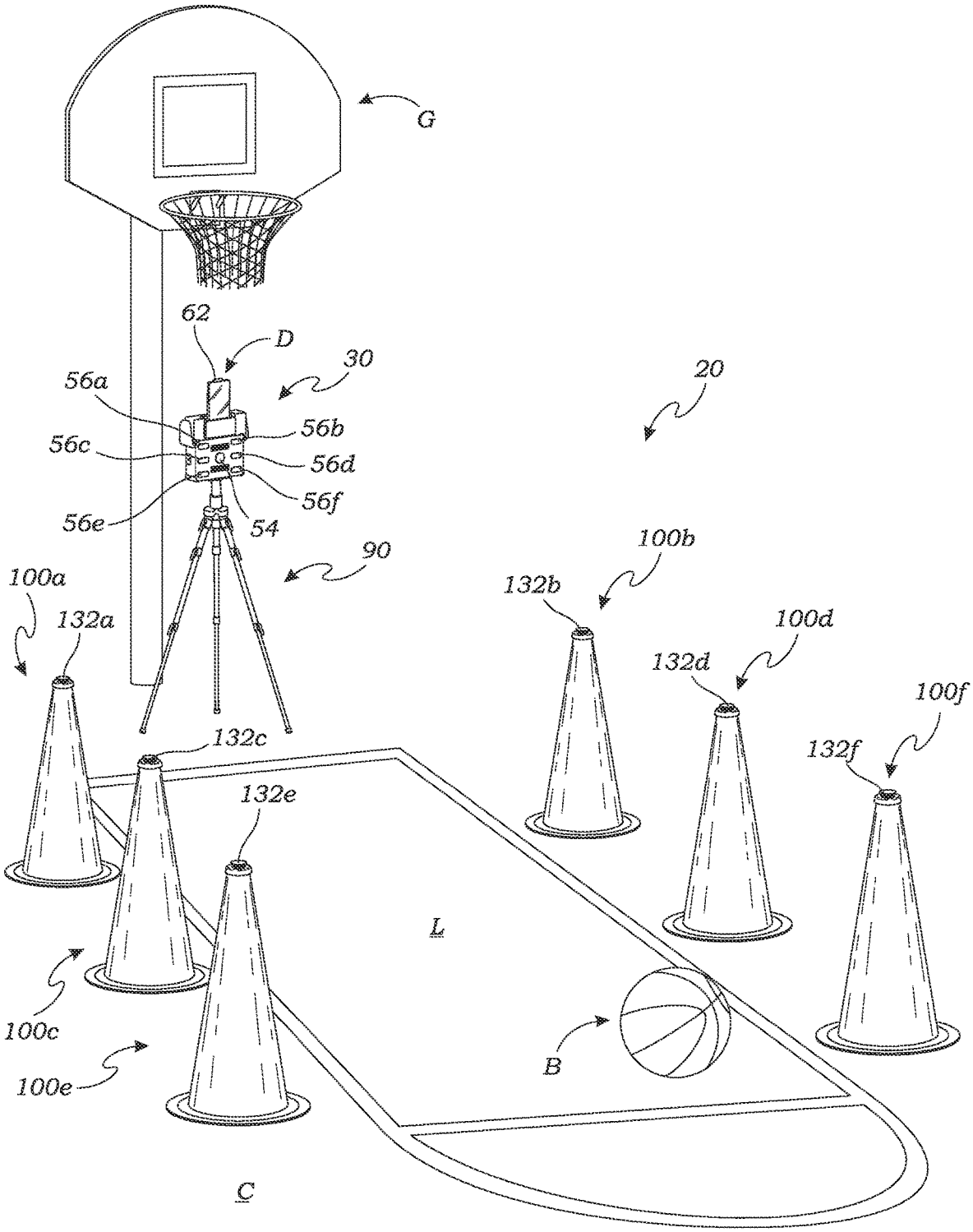
FIG. 8 is a reduced-scale perspective view of the exemplary dribble training system of FIG. 1 configured for use, in accordance with at least one embodiment.

Turning now to FIG. 1, there is shown a perspective view of an exemplary embodiment of a dribble training system 20 according to aspects of the present invention. The system 20 generally comprises, in the exemplary embodiment, an operable light board or base unit 30 and a set of operable cone units 100 wirelessly connected with the base unit such that interactions with the base unit 30 and any connected electronic device D (FIG. 8) may affect the cone units 100 and vice versa. As shown, the base unit 30 may be mounted on a stand 90 for proper positioning of the base unit 30 during use as explained further below, which stand 90 is generally configured as a tripod having a body 92 with three splayed and articulatable and adjustable legs 94, such as by telescoping for adjusting the overall height of the stand 90 and of the body 92 and the base unit 30 mounted thereon in a manner known and used in the art. While particular configurations of the core components of the exemplary dribble training system 20 are shown and described herein, it will be appreciated that such are merely illustrative of features and functionality of the present invention and non-limiting. Relatedly, while six cone units 100 are employed—three typically placed on the left side and three on the right side of a common training setup as shown in FIG. 8—and thus six corresponding cone indicator lights 56, three on the left and three on the right, are operably installed in the housing 40 of the base unit 30, it will be appreciated that such number and arrangement of cones 100 and related indicator lights 56 are again illustrative and non-limiting.

Figure 2:
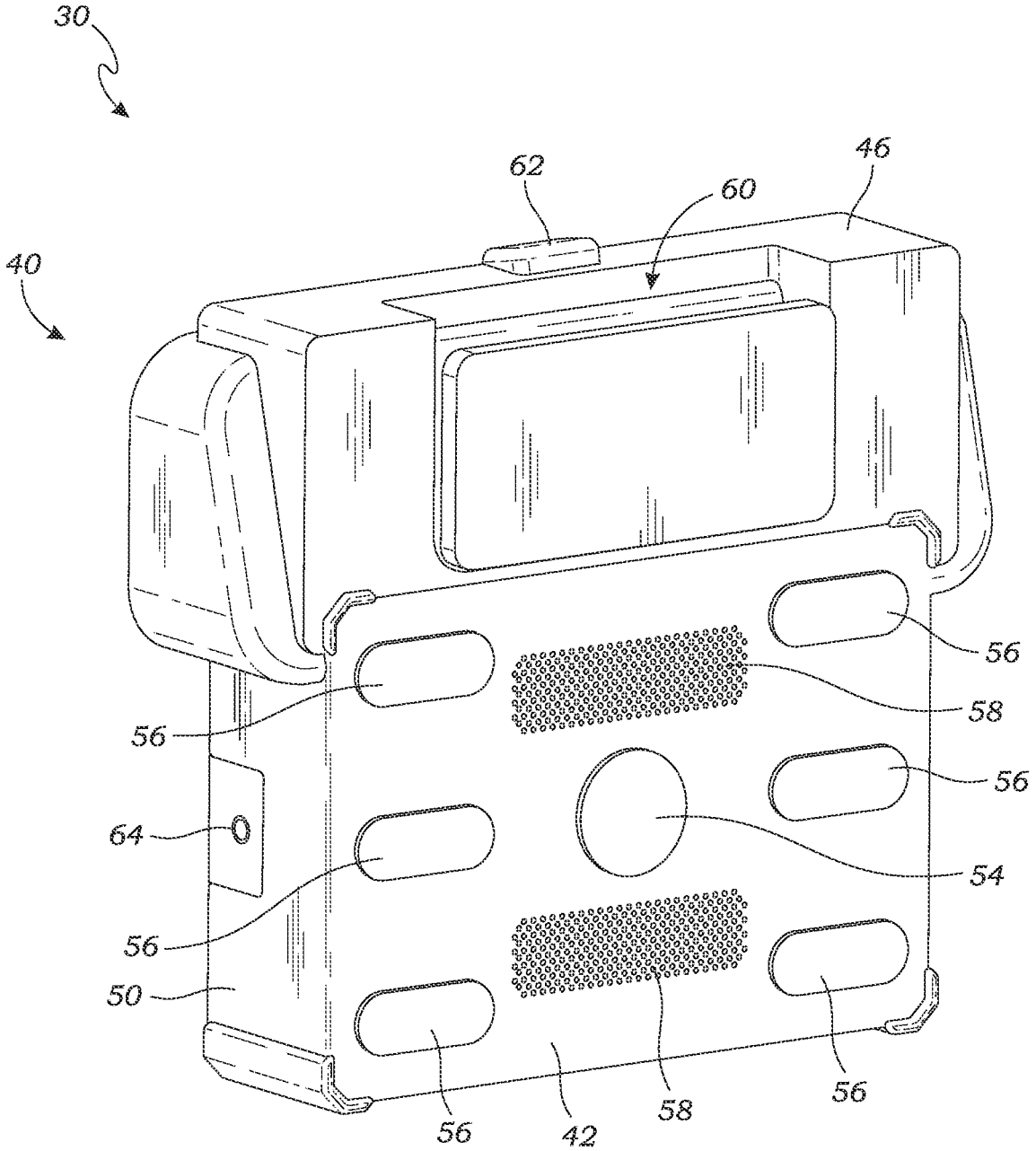
FIG. 2 is an enlarged front and top perspective view of an exemplary base unit thereof, in accordance with at least one embodiment.
Figure 3:
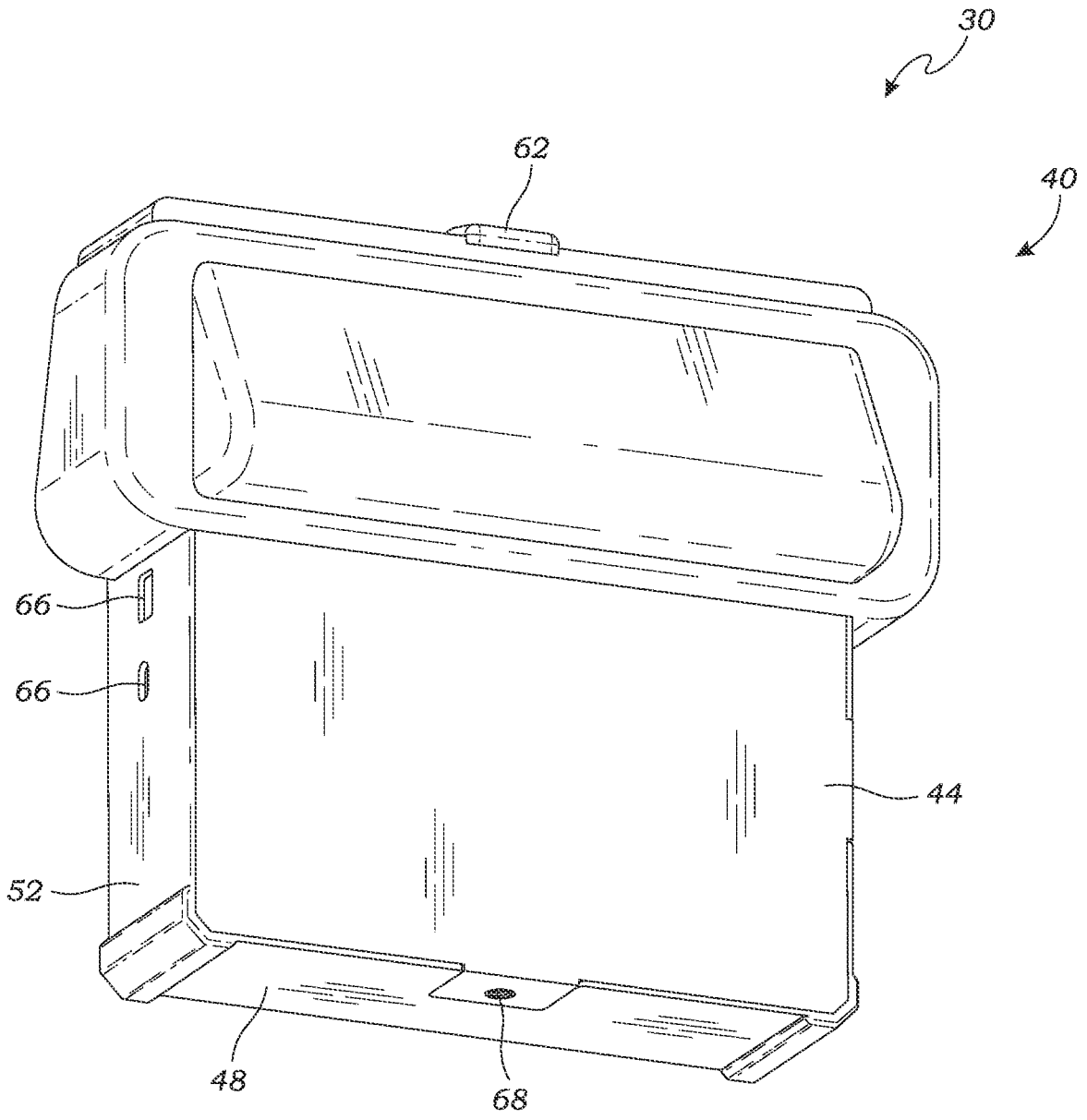
FIG. 3 is a rear and bottom perspective view of the exemplary base unit thereof, in accordance with at least one embodiment.

Referring to FIGS. 2 and 3, there are shown enlarged front and back perspective views of the exemplary base unit 30 of the dribble training system 20 (FIG. 1) according to aspects of the present invention as generally comprising a housing 40 having a front wall 42, an opposite back wall 44, a top wall 46, an opposite bottom wall 48, a left side wall 50, and an opposite right side wall 52. With reference particularly to the front perspective view of FIG. 2, operably installed in or on the front wall 42 again are the six cone indicator lights 56, three such indicator lights 56 spaced along the left portion of the front wall 42 and three such indicator lights 56 spaced along the right portion of the front wall 42 for ease of visibility during use of the system 20, the indicator lights 56 again corresponding to the six cone units 100 (FIGS. 1 and 5) as explained further below in more detail in connection with FIGS. 8 and 9. Centered on the front wall 42 of the base unit housing 40 is a stop/go indicator light 54 that as the name implies provides a visible "stop" and "go" indication to the user during any training exercise or game, such as red illumination indicating "stop" and green illumination indicating "go," as may be accomplished via multiple LEDs or color-changing LEDs or any other such illumination component now known or later developed in the art. And finally, on or in the front wall 42 there may be operably installed or positioned one or more audio speakers 58 for providing optional audio instructions or feedback during drills or games, shown as two spaced apart speakers 58 somewhat centered in the front wall 42 above and below the central stop/go indicator light 54 between the left and right sets of cone indicator lights 56. Of course, those skilled in the art will appreciate that all such configurations or layout arrangements are merely illustrative of features and aspects of the present invention and expressly non-limiting.

As also best seen in the front perspective view of FIG. 2, the housing 40 in the vicinity of the front wall 42 and the top wall 46 is formed having a receptacle 60 configured for removable receipt of an electronic device D (FIG. 8) such as a smartphone or tablet device that is capable of wireless (e.g., Wi-Fi and Bluetooth) communication or connection with the base unit 30 and of running a software application that directs use of the system 20 as through a variety of training exercises and games that are facilitated by the base unit 30 and cone units 100 and related user interaction or input as herein explained. Extendable from the top wall 46 of the housing 40 somewhat parallel with and offset from the receptacle 60 is an extendable and retractable arm 62, such as by being spring-biased closed or retracted that can secure the electronic device D on the base unit 30 and specifically on or in the receptacle 60 and whether in portrait or landscape orientation. Alternatively, it will be appreciated that the base unit 30 may be configured with an appropriate processor, Wi-Fi and/or other adapter, display screen, whether or not a touch screen, and other components so as to effectively comprise an integration of the exemplary base unit 30 with an electronic device D or the inclusion in the base unit 30 of the relevant functionality of an electronic device D such as a smartphone or tablet so as to be an all-in-one dedicated or purpose-built unit 30, such that a separate paired and temporarily secured electronic device D is not necessary.

With continued reference to FIG. 2, there is shown formed in the left side wall 50 of the base unit housing 40 a power/charging port 64. As will be appreciated by those skilled in the art with reference to the block diagram of FIG. 4, such power/charging port 64 is operably or electrically connected with a power supply 82 of the base unit 30 and any related power on/off switch 80, which power supply 82 may be an AC power source and related transformer such as a 5V, 3A AC/DC converter (not shown) as by being plugged into a supply or wall outlet or other such voltage source or may be a rechargeable DC or battery power source, in any event employing any such power supply 82 whether now known or later developed as appropriate as may be connected or charged through such exemplary power/charging port 64 and able to power the base unit 30 for a desired amount of time in connection with operation of the system 20. In the case of an internal rechargeable battery, it will be appreciated that such along with any other electronics such as shown schematically in the block diagram of FIG. 4 may be housed within the base unit housing 40 in any appropriate manner now known or later developed. It will also be appreciated that the configuration and location of any such power/charging port 64 may vary, such that the illustrated version as shown in FIG. 2 is to be understood as exemplary and non-limiting.

Turning now to the rear perspective view of the base unit 30 of FIG. 3, there is shown formed on or in the right side wall 52 of the housing 40 one or more data ports 66 such as a USB or USB-C jack for wired connection to an electronic device D or other computer or computing device as from time to time be desired for uploading or downloading data to or from the base unit 30, such as in the event software programs or firmware is to be installed or updated or any diagnostic or other data is to be pulled from the base unit 30. Again, the configuration and location of such data ports 66 may be any connection now known or later developed in the electronics arts.

As also seen in FIG. 3, substantially centered in the bottom wall 48 and somewhat adjacent to the back wall 44 of the base unit housing 40 is a threaded mounting hole 88 for removably and threadably engaging a related screw (not shown) of the stand 90 for selectively installing and supporting the base unit 30 in a desired vertical orientation and position during use of the dribble training system 20 (FIG. 1). Those skilled in the art will appreciate that any such mechanical engagement or fastening means now known or later developed for temporarily securing the base unit 30 on the stand 90 may be employed according to aspects of the present invention without departing from its spirit and scope. In the exemplary embodiment, a nominal one-quarter inch, twenty threads per inch (¼-20) thread is employed.

Figure 4:
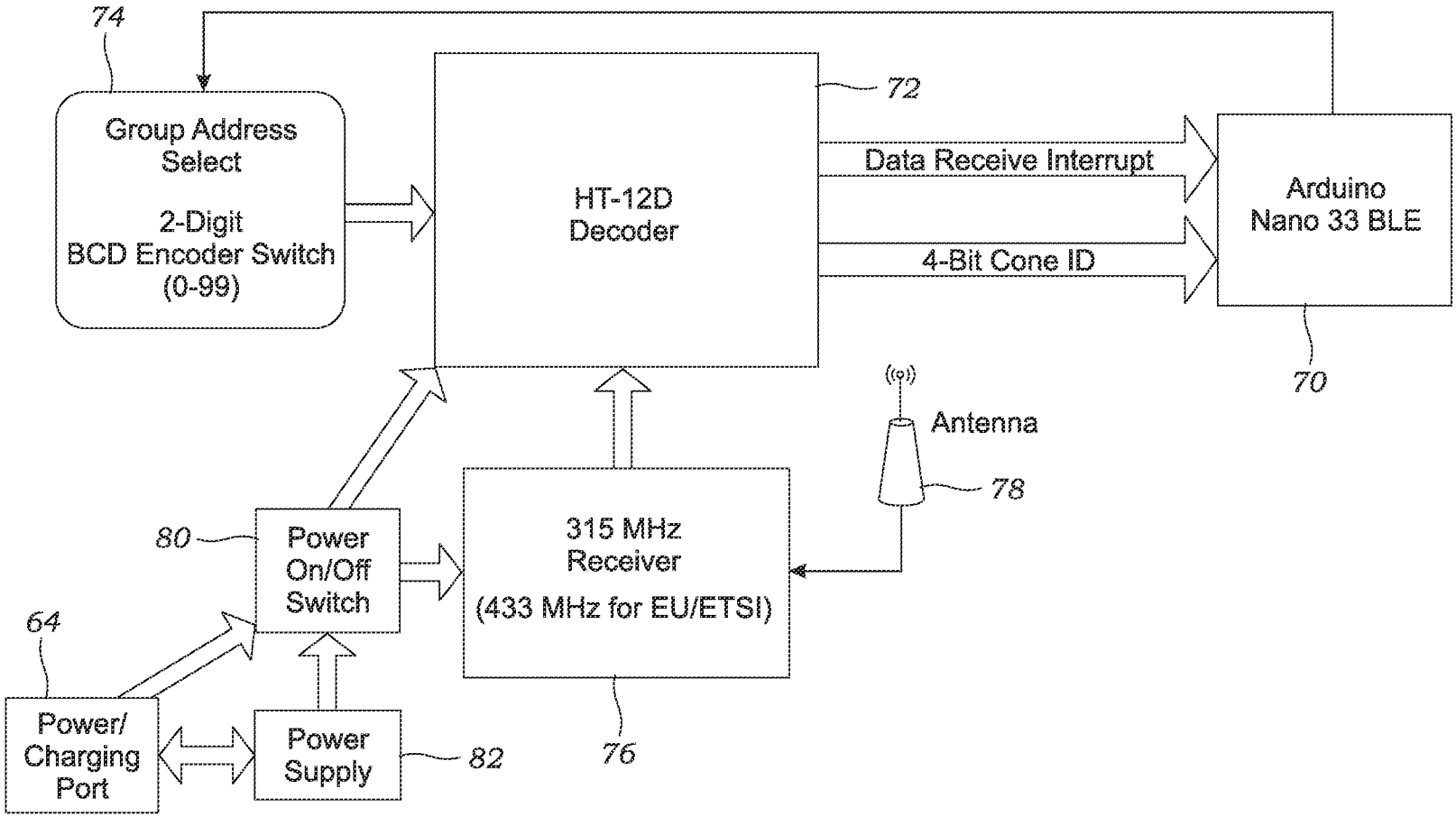
FIG. 4 is a block diagram of the exemplary base unit thereof, in accordance with at least one embodiment.

Referring next to FIG. 4, there is shown a block diagram of the main electronics components of the exemplary base unit 30 (FIGS. 2 and 3) of the dribble training system 20 (FIG. 1) according to aspects of the present invention. A main base unit processor 70 is shown as comprising an "Arduino Nano 33 BLE" processor and being electrically connected to other representative components such as the decoder 72 indicated as an "HT-12D Decoder" and the encoder 74 indicated as a "2-Digit BCD Encoder (0-99)" for setting the pairing of the base unit 30 with the cone units 100, which together allow the processor 70 in conjunction with the receiver 76 labeled as a "315 MHz Receiver (433 MHz for EU/ETSI)" and its connected antenna 78 to communicate with the cone units 100 (FIGS. 1 and 5) during use of the system 20. In the illustrated embodiment, the receiver 76 is a wireless receiver rated at 315 MHz and 4800 bps such as the WRL-10533 receiver manufactured by Sparkfun. Notably, the antenna 78 is to be of sufficient size and configuration to allow for signal transmission integrity between the base unit 30 and the cone units 100 in a variety of contexts, including inside buildings such as gymnasiums and at various distances. In one exemplary embodiment, the specifications of the antenna 78 are a helical coil style antenna that is 35 mm long and 7 mm in diameter rated at up to 315 MHz and an impedance of 50 Ohms such as the W3126 antenna by PulseLarsen. The encoder 74 labeled as "2-Digit BCD Encoder (0-99)" in the exemplary embodiment is the B3U-3000P-B switch manufactured by Omron. It will be appreciated that all such electronics components are illustrative and non-limiting and any appropriate component or components now known or later developed as functionally allowing for operation of the base unit 30 as herein described may be added or substituted without departing from the spirit and scope of the invention. Specifically, while the illustrated processor 70 is indicated as an "Arduino Nano 33 BLE" processor, those skilled in the art will appreciate that a wide variety of processors whether now known or later developed may be employed. As illustrated, any such processor 70 may supply power or electrical connectivity to the encoder 74 for setting the 2-digit encoder value for pairing with the cone units 100 and may receive from the decoder 72, among other things, the single-digit 4-bit cone ID communicated from the decoder 72 to the processor 70 as received from the cone units 100 during setup based on wireless communication between the base unit 30 and the cone units 100 for uniquely identifying each of the six cone units 100 as needed for operation of the system 20. And once more, regarding powering the base unit 30, the power supply 82 may be an AC power source and related transformer (not shown) as by being plugged into a supply or wall outlet or other such voltage source or may be a rechargeable DC or battery power source, in any event employing any such power supply 82 whether now known or later developed as appropriate as may be connected or charged through such exemplary power/charging port 64 and able to power the base unit 30 for a desired amount of time in connection with operation of the system 20, such as ten or more hours in the case of a battery power supply 82. And as illustrated, the power supply 82 and the power/charging port 64 are in electrical communication as are both the power supply 82 and the power/charging port 64 with the power on/off switch 80, such that, for example, in the case of an AC powered base unit 30, the power supply 82 thus runs through the power/charging port 64 and then the power on/off switch 80, while in a DC or battery context the power/charging port 64 is only employed in connection with recharging the battery power supply 82 which itself supplies power to the circuit through or based on the power on/off switch 80. Referring again to FIG. 2, while the power on/off switch 80 is not shown on or in the base unit housing 40, it will be appreciated that it may be located anywhere as appropriate, or on any of the walls 42, 44, 46, 48, 50, 52 of the housing, or may even be co-located with another feature such as the central stop/go light 54, which may also be a power switch, such as an illuminated or illuminable toggle switch. In any event, it will further be appreciated that equipping the base unit 30 with an on/off switch 80 will provide the option for the user to switch the base unit 30 on or fully off (no power to the base unit 30 at all), thereby preserving the battery life in the case of a DC power supply 82.

Figure 5:
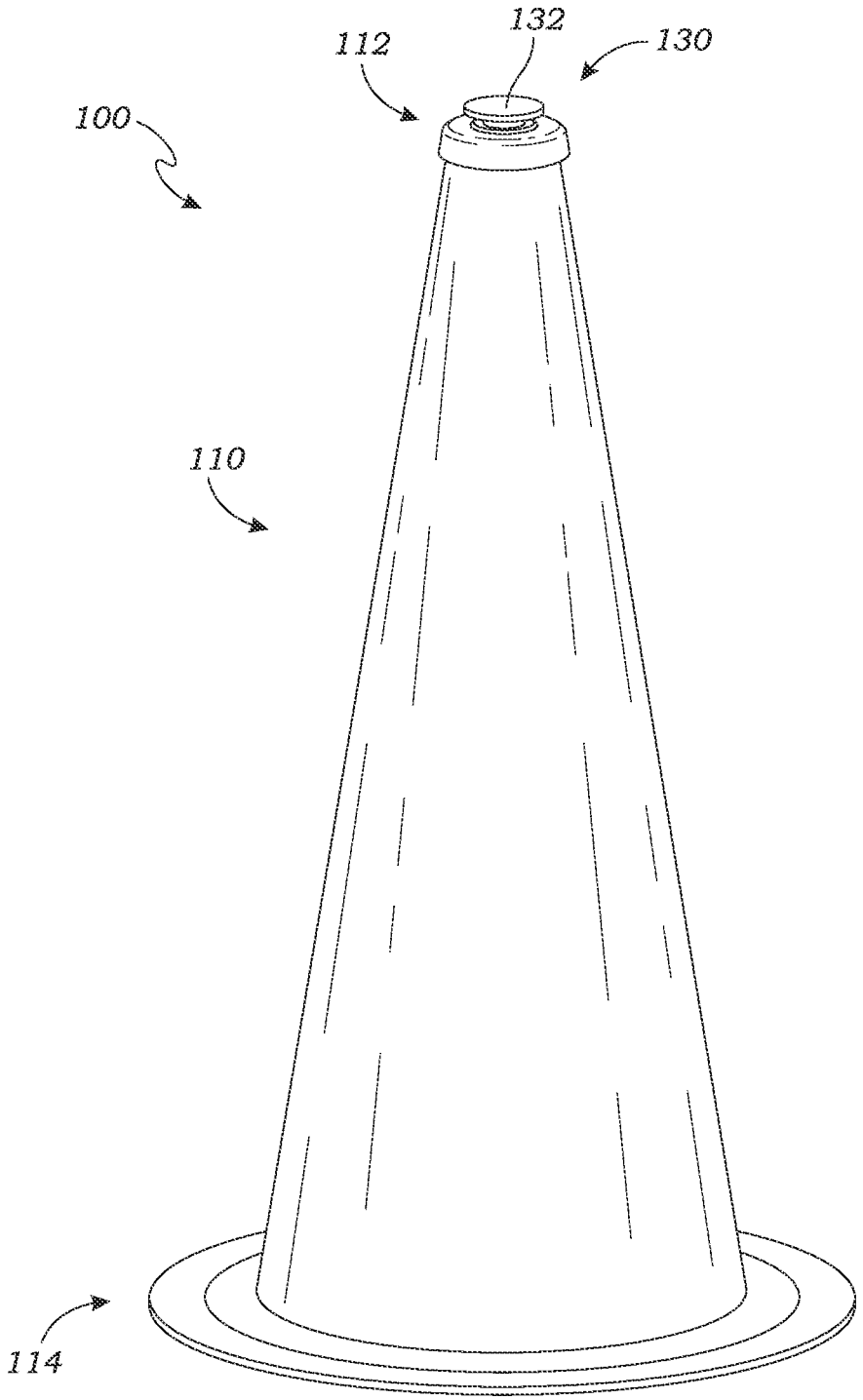
FIG. 5 is an enlarged front perspective view of an exemplary cone unit thereof, in accordance with at least one embodiment.
Figure 6:
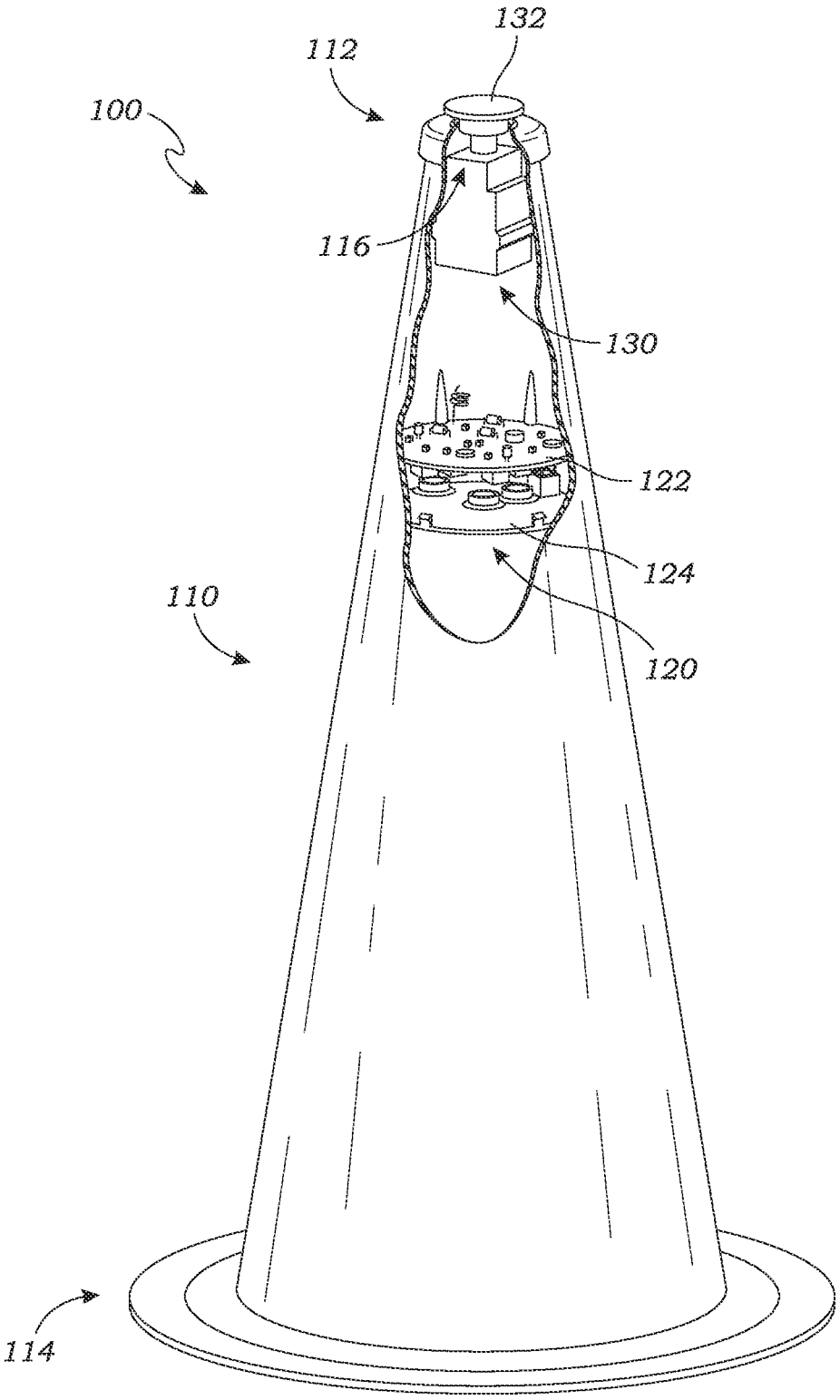
FIG. 6 is a partially cutaway front perspective view of the exemplary cone unit thereof, in accordance with at least one embodiment.

Turning now to FIGS. 5 and 6, there are shown enlarged perspective views, the latter partially cut-away, of an exemplary cone unit 100 of a dribble training system 20 (FIG. 1) according to aspects of the present invention. As shown, the cone unit 100 generally comprises a cone body 110 having a relatively narrower upper end 112 and a relatively wider lower end 114 as a typical cone is configured, the lower end 114 thereby providing a stable base for the cone 100 during use. A button module 130 having an exposed and actuatable button 132 is operably installed in the opening 116 formed in the narrow upper end 112 of the cone body 110. Below the button module 130, as seen in FIG. 6 there is a related electronics module 120 generally comprising at least one circuit board 122 with related circuit elements as shown and described below in connection with FIG. 7 and an offset battery cover 124 serving to enclose or at least partially encase the circuit board 122 and any batteries therein or therebetween for powering the electronics module 120 and the button module 130. Though not shown, the electronics module 120 and the button module 130 are to be electrically connected for operation thereof. Particularly, when a cone unit 100 is in use or is to be configured for use, the button module 130 is operably installed in the mouth or opening 116 at the upper end 112 of the cone as by a snap, twist-lock or keyed, or interference fit or any other removable engagement means now known or later developed in the art. Relatedly, below and adjacent to the button module 130 within the cone body 110, the electronics module 120 may be operably installed, both mechanically as again by a snap, twist-lock or keyed, or interference fit or other means and electrically as by being plugged into or wired or otherwise connected to the button module 130. In this manner, the bulk of the components being housed within the cone body 110, they are protected from damage or becoming dislodged or disconnected during training drills or game play with the system 20 as by being accidentally struck by a user or a ball B (FIG. 8). Moreover, it will be further appreciated that by the electronics and button modules 120, 130 being removable from the cone body 110, each such cone body 110 may be "stripped" when not in use for easier storage and/or transport as by then stacking or nesting the cone bodies 110, six in all in the exemplary embodiment, and separately storing the electronics and button modules 120, 130 along with the base unit 30 (FIGS. 1-3) in a box (not shown) or the like. Alternatively, the cone units 100 may be stacked one cone body 110 on another even without removing the electronics and button modules 120, 130, particularly if such are configured with relatively low profiles for relatively further nesting of the cones 100 together again during storage and/or transport.

Figure 7:
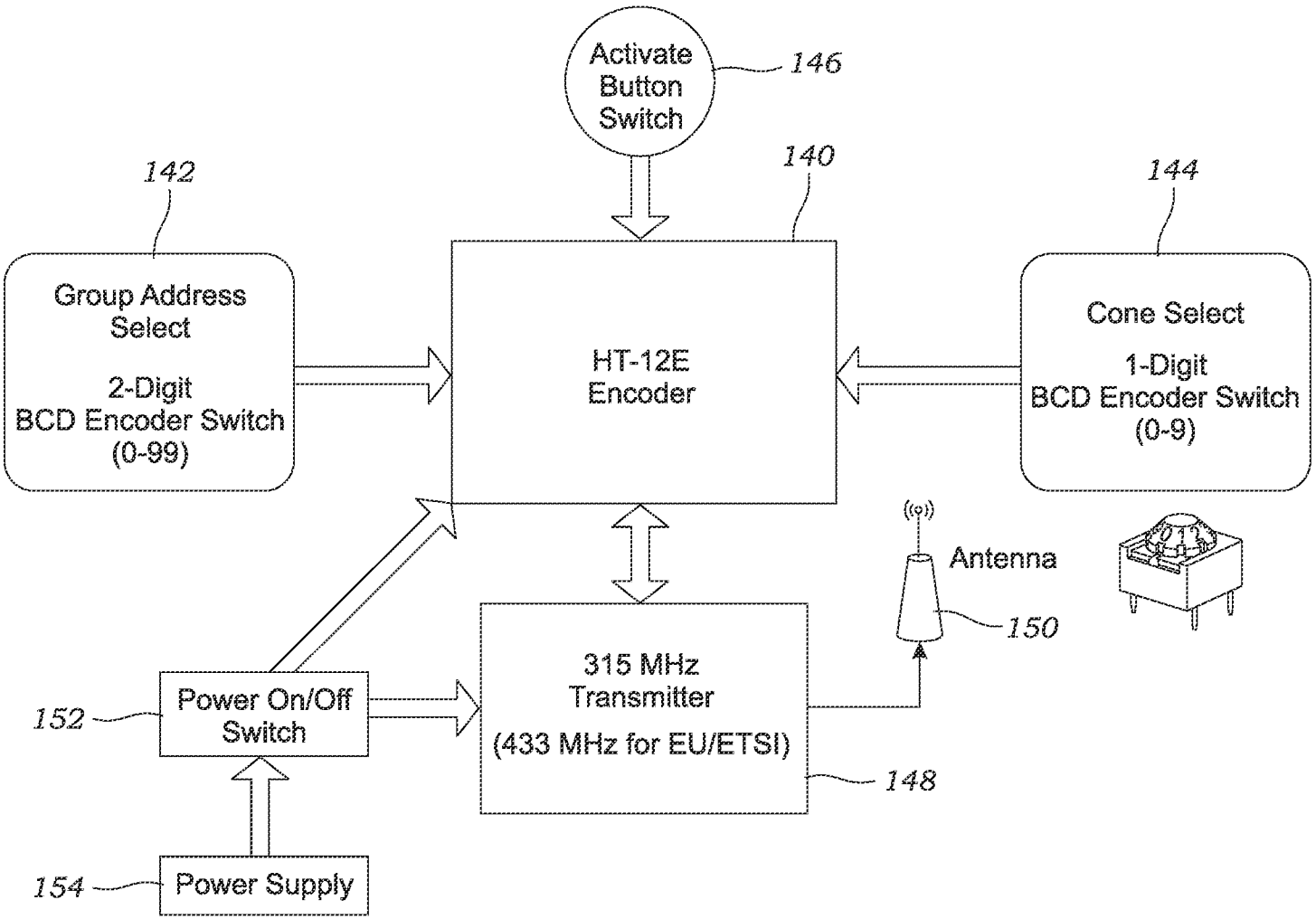
FIG. 7 is a block diagram of the exemplary cone unit thereof, in accordance with at least one embodiment.

Referring likewise to FIG. 7, there is shown a block diagram of the main electronics components of the exemplary cone unit 100 (FIGS. 5 and 6) of the dribble training system 20 (FIG. 1) according to aspects of the present invention. A main encoder 140 is indicated as an "HT-12E Encoder" electrically connected to other representative components such as a first encoder 142 indicated as a "2-Digit BCD Encoder Switch (0-99)" for setting the pairing of the respective cone unit 100 with the base unit 30 and a separate second encoder 144 indicated as a "1-Digit BCD Encoder Switch (0-9)" for unique cone identification, the switch allowing for ten selections with there being six cone units 100 in the exemplary embodiment, which encoders 142, 144 together allow the main encoder 140 in conjunction with the transmitter 148 labeled as a "315 MHz Transmitter (433 MHz for EU/ETSI)" and its connected antenna 150 to communicate with the base unit 30 (FIGS. 1-3) during setup and use of the system 20, including identifying to the base unit 30 which cone unit 100 is which as being one of the six cones in the exemplary system 20, here being numbered cones 0 to 5 employing the second encoder 144 in each cone unit 100 and respective electronics module 120, specifically. In the illustrated embodiment, the transmitter 148 is a wireless transmitter rated at 315 MHz and 4800 bps such as the WRL-10535 transmitter manufactured by Sparkfun. Once again, in the interest of the antenna 150 being of sufficient size and configuration to allow for signal transmission integrity between the base unit 30 and the cone units 100 in a variety of contexts, including inside buildings such as gymnasiums and at various distances, in the exemplary embodiment, the specifications of the antenna 78 are a helical coil style antenna that is 35 mm long and 7 mm in diameter rated at up to 315 MHz and an impedance of 50 Ohms such as the W3126 antenna by PulseLarsen. The first encoder 142 labeled as "2-Digit BCD Encoder Switch (0-99)" in the exemplary embodiment is the B3U-3000P-B switch manufactured by Omron, and the second encoder 144 labeled as "1-Digit BCD Encoder Switch (0-9)" in the exemplary embodiment is the A6A-10RS switch manufactured by Omron. It again will be appreciated that all such electronics components are illustrative and non-limiting and any appropriate component or components now known or later developed as functionally allowing for operation of the cone units 100 as herein described may be added or substituted without departing from the spirit and scope of the invention. As illustrated, the encoder 140 may supply power or electrical connectivity as needed to the first and second encoders 142, 144 for setting the 2-digit encoder value for pairing with the base unit 30 and for receiving from the second encoder 144 the single-digit 4-bit cone ID for communication to the base unit 30 during setup based on wireless communication between the cone units 100 and the base unit 30 for uniquely identifying each of the six cone units 100 as needed for operation of the system 20. And once more, regarding powering the cone units 100, each may be equipped with a battery power supply 154, whether replaceable or rechargeable and whether now known or later developed, operably electrically connected to the rest of the circuit through a power on/off switch 152 and able to power the cone unit 30, and particularly the electrical and button modules 120, 130 thereof, for a desired amount of time in connection with operation of the system 20, such as ten or more hours. In an alternative embodiment wherein the cone units 100 are stacked without removing the electronics and button modules 120, 130 and wherein the each power supply 154 involves rechargeable batteries, such cone units 100 may be configured such that the electronics and button modules 120, 130 make electrical contact with each other when stacked end-to-end, such that by supplying AC or wall or outlet power (voltage) to one cone unit 100 in the series, all such cone units 100 and the power supplies 152 thereof may be simultaneously charged. Alternatively, even where the electronics and button modules 120, 130 are removed for stacking of the cone bodies 110, such electronics and/or button modules 120, 130 may still be connected to each other in series when stored such that a single wired or plugged connection can charge the entire group of electronics and/or button modules 120, 130 at one time. And once more, the power supply 154 being connected through the power on/off switch 152, it will be appreciated that equipping the base unit 30 with such an on/off switch 80 will provide the option for the user to switch each cone unit 100 on or fully off (no power to the cone unit 100 at all), thereby preserving the battery life of the power supply 154. Referring again to FIGS. 5 and 6, while the power on/off switch 152 is not shown on or in the cone unit body 110 or specifically on the electronics module 120, it will be appreciated that it may be located anywhere as appropriate. And regarding the button module 130, once the cone units 100 are each positioned as desired and linked with the base unit 30 uniquely as through the 1-digit cone identifier set by the respective cone's second encoder 144, during use as explained further below in connection with FIGS. 8 and 9, actuating the button 132 as by pushing or striking the button 132 with a user's hand during training or play is to effectively actuate the related activate button switch 146 electrically coupled to the main encoder 140 thereby registering such touch as part of operation of the system 20. Once more, those skilled in the art will appreciate that the exemplary configuration of the cone unit 100 and its related components are merely illustrative and non-limiting and that other configurations of the cone unit 100 hardware and electronics whether now known or later developed may be employed according to aspects of the present invention without departing from its spirit and scope.

In forming the base unit 30, including the housing 40 and receptacle 60 and related arm 62, the related stand 90 for the base unit 30, and the cone unit 100, including the cone body 110 and the button module 130 and related button 132, it will be appreciated that any appropriate materials and methods of construction now known or later developed may be employed, including but not limited to metals such as steel, aluminum, alloys, and the like and a variety of plastics such as polypropylene, polystyrene, polyvinyl chloride ("PVC"), acrylonitrile butadiene styrene ("ABS"), polyethylenes such as high density polyethylene ("HDPE") and low density polyethylene ("LDPE"), polycarbonate, polyurethane, and other such plastics, thermoplastics, thermosetting polymers, and the like, any such components being fabricated or formed as through injection molding, casting, extrusion, machining, stamping, forming, or any other such technique now known or later developed. Relatedly, such components may be formed integrally or may be formed separately and then assembled in any appropriate secondary operation employing any assembly technique now known or later developed, including but not limited to fastening, bonding, welding, over-molding or coining, press-fitting, snapping, or any other such technique now known or later developed. Those skilled in the art will fundamentally appreciate that any such materials and methods of construction are encompassed within the scope of the invention, any exemplary materials and methods in connection with any and all embodiments thus being illustrative and non-limiting. It will also be appreciated particularly that any electronics components employed in the units or assemblies making up the overall dribble training system 20 may be "off the shelf" such as those exemplary components indicated elsewhere herein and that any such components now known or later developed may be added or substituted. Dimensionally, the overall size and scale or proportionality of any such system 20 may vary widely as can the number and arrangement of the components, particularly the cones 100, based on a number of factors and contexts—in the exemplary system 20, once more, a single base unit 30 and six cone units 100 are employed, with the height of each cone unit 100 being in the range of roughly eighteen to thirty inches (18-30 in.) tall having a base in the range of roughly nine to fifteen inches (9-15 in.), though again other sizes and shapes or configurations are possible according to aspects of the present invention, including the base of the cones 100 being square, octagonal, or some other shape other than round. The stand 90 employed in selectively supporting the base unit 30 in an elevated, substantially vertical orientation may enable a wide range of heights of the base unit 30 off of the ground from roughly two feet to as much as five feet (2-5 ft.) or more. The base unit 30 itself may be on the order of roughly six to twelve inches (6-12 in.) wide and four to eight inches (4-8 in.) tall, with its thickness or depth being on the order of two to four inches (2-4 in.). Once again, those skilled in the art will appreciate that a wide range of configurations, or sizes and geometries, of the system 20 and its related components may be employed according to aspects of the present invention without departing from its spirit and scope, such that the indicated exemplary dimensions are to be understood as merely illustrative and non-limiting.

Turning to FIG. 8, the exemplary dribble training system 20 according to aspects of the present invention is illustrated in an exemplary setup for use. As shown, the system 20 may be employed on a basketball court C, whether indoor in a gym or outdoor as illustrated, though it will be appreciated that use of the system 20 on an actual basketball court is not required and virtually any relatively flat and relatively hard surface will suffice, such as a driveway, parking lot, etc., and in the case of non-dribbling conditioning and reaction time training, it is not even necessary that the surface be that flat or hard. Here, for a basic setup referred to as "The Standard" that is to be used for a variety of basketball dribbling training drills and games, the system 20 is thus arranged such that the base unit 30 and stand 90 on which it is installed are positioned along the baseline of the court C substantially centered in front of or under the basketball goal G and facing into the court C down the lane L that is typically marked on the court C. The six cone units 100 are then positioned along or just inside or outside of the lane L, three on each side. Specifically, from the vantage point shown or as facing the goal G and the base unit 30, or looking down the lane L toward the goal G, cone unit 100*a* is positioned at the front left area of the lane L and corresponds to the top left cone indicator light 56*a* on the base unit 30, cone unit 100*b* is positioned at the front right area of the lane L and corresponds to the top right cone indicator light 56*b* on the base unit 30, cone units 100*a* and 100*b* thus being closest to the base unit 30, cone unit 100*c* is positioned at the middle left area of the lane L and corresponds to the middle left cone indicator light 56*c* on the base unit 30, cone unit 100*d* is positioned at the middle right area of the lane L and corresponds to the middle right cone indicator light 56*d* on the base unit 30, cone unit 100*e* is positioned at the back left area of the lane L and corresponds to the bottom left cone indicator light 56*e* on the base unit 30, and cone unit 100*f* is positioned at the back right area of the lane L and corresponds to the bottom right cone indicator light 56*f* on the base unit 30, cone units 100*e* and 100*f* thus being farthest from the base unit 30. Those skilled in the art will appreciate that with the lane L of a basketball court typically being nineteen feet long by twelve feet wide (19 ft.×12 ft.), with the goal G overhanging the court by four feet (4 ft.) such that the distance from the free throw line to the goal is fifteen feet (15 ft.), the spacing of the cone units 100 in the illustrated "The Standard" setup of the system 20 is such that the cone units 100 along each side are about four to six feet (4-6 ft.) apart and the left and right cone units 100 are about ten to fifteen (10-15 ft.) apart. Though once again, it will be appreciated that a wide variety of setups are possible depending on the training or game play objectives and the physical space available.

Figure 9:
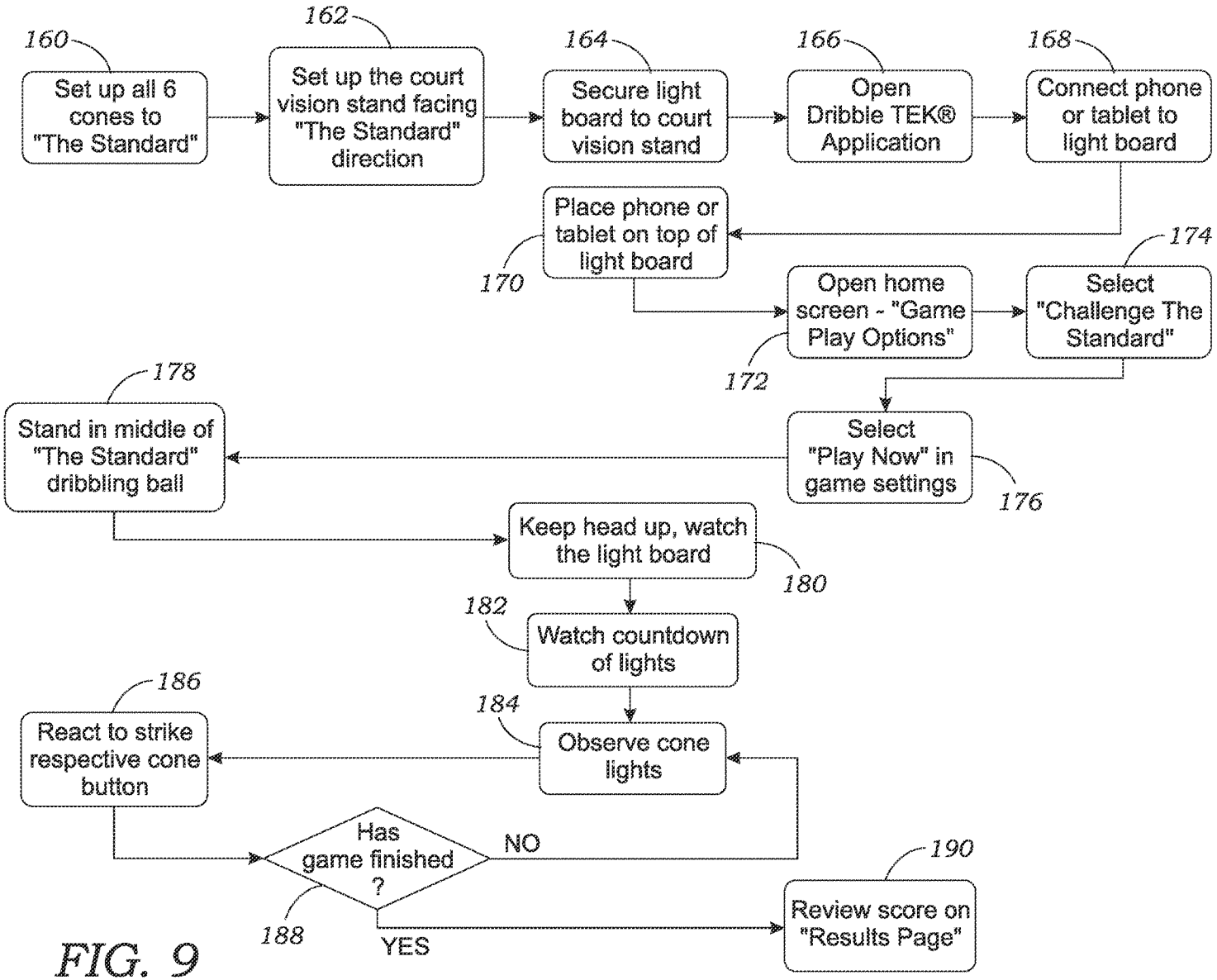
FIG. 9 is a flow chart depicting use of the exemplary dribble training system of FIG. 8, in accordance with at least one embodiment.

With continued reference to FIG. 8 and now also to the flow chart of FIG. 9, use of the exemplary dribble training system 20 according to aspects of the present invention begins at step 160 with setting up the six cone units 100 to the "The Standard" configuration as shown and described above. Next, or really concurrently with or even prior to positioning the six cone units 100, at step 162 the stand 90 is positioned as desired, which it will be appreciated serves as a reference point for placing the cone units 100, at step 164 the base unit 30 is secured or mounted on the stand 90, at step 166 the related software app is opened or run on an electronic device D and at step 168 the device D is then wireless connected to or paired with the base unit 30, and then at step 170 the paired electronic device D running the related software app is secured on the base unit 30 as shown. Once more, those skilled in the art will appreciate that setup steps 160-170 can essentially be done in any logical sequence, such that the sequence represented in FIG. 9 is to be understood as merely illustrative and non-limiting. For example, step 166 of running the software app and step 168 of connecting the electronic device D running the app to the base unit 30 can be done after the device D is physically mounted on the base unit 30 per step 170. Similarly, the step of installing the base unit 30 on the stand 90 per step 164 could be performed prior to positioning the stand 90 at the desired location and orientation per step 162, again, both of which steps 162 and 164, and really steps 166, 168, and 170, potentially preceding the actual placement of the cone units 100 per step 160, depending on a number of factors and preferences. By way of further illustration and not limitation, the electronic device D and any software operably installed thereon may include a GPS or wireless measurement tool for measuring distances between points, which tool may prove handy in arranging the cone units 100 as desired. Of course, other measurement tools ranging from a tape measure to the old-fashioned step-off can be used for cone unit 100 placement. It will be appreciated that details not indicated in the flow chart of FIG. 9 but inherent to or prerequisites for the indicated steps include powering up the electronic device D and installing any required software related to the system 20 and its instructions for setup and use and powering on both the base unit 30 and each cone unit 100 as herein described.

Back to step 160, the arrangement of the cone units 100 would in the exemplary embodiment generally be as shown in FIG. 8, with the location and identification of each cone unit 100 communicated to the base unit 30 during the pairing process, so that the base unit ultimately knows which cone unit 100*a*, 100*b*, 100*c*, 100*d*, 100*e*, 100*f* is where. In a bit more detail regarding step 160 and setting up the cones 100 and also with reference again to FIGS. 4 and 7, a "group select" rotary switch or other such encoder 74, 142 located in the base unit 30 and the cone units 100, respectively, are used to set the group number (a range from 0-99) for pairing of the cone units 100 with the base unit 30. Within one unique system 20, each cone unit 100 must have the same group select number for pairing with a single base unit 30 that is set to the same group select number (again, in the range from 0-99). Accordingly, it will be appreciated that multiple dribble training systems 20 may operate or be used in proximity to each other, such as may be the case in the context of a basketball camp or clinic, without any such system 20 interfering with the operation of the others by each having a unique frequency effectively at which its wireless connectivity operates (in theory, up to one hundred such systems 20 could operate in proximity based on the exemplary encoders 74, 142). Further, each cone unit 100 is again also equipped with a second encoder 144 or "cone select" rotary switch or the like for setting the cone identification number (a range of 0-9) within the group of cone units 100 paired with a single base unit 30 in the unique system 20. The six cone units 100 within a system 20 must each have a unique cone number selected with the "cone select" rotary switch 144. In an exemplary embodiment, each of the six cone units 100 is assigned a unique number from 0 to 5 (i.e., a cone unit 100 would not be assigned a number outside of the 0 to 5 range). Here, those skilled in the art will appreciate that based on the exemplary embodiment, up to ten unique cone units 100 could be employed in a single training system 20, and of course a different switch or encoder could be employed such as the 2-digit (0-99) encoder employed in pairing the group of cone units 100 with a base unit 30, such that more than ten cone units 100 could be employed with a single base unit 30, though in most contexts that would be unnecessary and impractical in use. By way of further illustration and not limitation, in an alternative embodiment each cone unit 100 may be substantially autonomous and "intelligent" as by being not only wirelessly connected to the base unit 30 but also having geospatial location capability as through GPS technology or the like or through triangulation or other location technique relative to the base unit 30 in terms of relative distance and direction away from such a fixed reference point so that at all times the location of each such cone unit 100 is known or knowable, in both the absolute sense and relative to the base unit 30, and self-mobility as by having a motorized drive system or the like. Accordingly, based on the software app running on the electronic device D and/or the base unit 30 firmware, and depending on selections made by a user during game selection and setup, the cone units 100 may effectively automatically position themselves relative to the base unit 30 by pinpoint location determination combined with self-directed navigation to such prescribed pinpoint location or coordinates essentially. It will be appreciated that in this manner, pairing the electronic device D and the related software app that is installed and running in the device D with the base unit 30 and hence the cone units 100 allows for selections made in the app to directly affect the autonomous locations of the "intelligent" cones 100 suitable for the gameplay selected as at step 160 in FIG. 9, once the cones 100 are powered and paired as described herein. Moreover, this same capability can facilitate rapid repositioning of the cones 100 when a different game is selected through the app via the electronic device D or even dynamic movement of the cones 100 during gameplay in some contexts.

With continued reference to FIGS. 8 and 9, regarding step 166 of opening or running the "DribbleTEK" app on the electronic device D such as a smartphone or tablet and step 168 of wirelessly connecting the device D with the base unit 30, with such software app installed on the device D in any appropriate manner now known or later developed in the art, upon first use, the base unit 30 needs to be wirelessly paired with the electronic device D, such as in the exemplary embodiment via Bluetooth, as by first powering up the base unit 30 and then going to "settings" for the device D and selecting "pair new device" or the like and in the exemplary embodiment selecting "DribbleTEK" from the device list, upon which the DribbleTEK base unit 30 and the electronic device D running the DribbleTEK software app should be paired.

Regarding the hardware aspects of the setup for use of the exemplary dribble training system 20 beyond placing and linking the cone units 100 with the associated base unit 30 as herein described, it is again noted that the stand 90 for the base unit 30 is configured in the exemplary embodiment as a tripod with three adjustable and articulating legs 94 and a central body 92 (FIG. 1) on which the base unit 30 is removably installed as through the engagement of a mounting screw (not shown) with the mounting hole 68 (FIG. 3) formed in the bottom wall 48 of the base unit housing 40 (FIG. 3). As such, it will be appreciated that the height of the base unit 30 is adjustable to suit the user and the particular training drill or game and related objectives. And for purposes of securing the electronic device D such as a smartphone or tablet on the base unit 30, once more, there is formed in the base unit housing 40 substantially at the front and top walls 42, 46 a generally upwardly-opening receptacle 60 above the stop/go indicator light 54, the array of cone indicator lights 56 (six in the exemplary embodiment), and the speaker(s) 58, the receptacle 60 configured for removable or temporary receipt of the electronic device D, which of course would be positioned facing out or away from the base unit 30 or facing the same direction as the base unit front wall 42 and all such indicator lights 54, 56. In the exemplary embodiment, such receptacle 60 may house a variety of smartphone or tablet devices D, in whole or in part, with there provided adjacent to the receptacle 60 an extendable and retractable (e.g., spring-biased) arm 62 for selectively engaging a top edge of the electronic device D so as to better secure the device D on the base unit 30, particularly observing that the base unit 30 and related stand 90 may be jostled during use of the system 20 as by being bumped by a user or a ball B. It is noted that any such electronic device D may be positioned on the base unit 30 in a portrait (vertical) or landscape (horizontal) orientation and further that the DribbleTEK app running on the electronic device D allows for either orientation as well.

In terms of actual drills or gameplay with the exemplary dribble training system 20 according to aspects of the present invention, more about which is said below, it is generally noted with reference again to the flow chart of FIG. 9 that at step 172 after setup completion a user would open the "home screen" of the DribbleTEK software app running on the electronic device D and select "Game Play Options." From there a number of such options would be presented to the user depending on the system 20 and the user's subscription level or access to particular drills and games. By way of continued illustration and not limitation, at step 174, when the exemplary "Challenge The Standard" game is to be played, the user would select "Challenge The Standard" from the available gameplay options and then select "Play Now" in the game settings or menu as presented to the user on the screen of the electronic device D as indicated at step 176. As indicated at step 178, the user or the person who will actually play the game would then position himself or herself in the middle of the cone units 100, or with reference to FIG. 8 in the middle of the lane L between the left and right middle cone units 100*c*, 100*d* dribbling the basketball B, and as indicated at steps 180 and 182 the user would keep his or her head up, watching the base unit 30 and any countdown lights or the like on the display of the electronic device D until the countdown reaches "zero" and the stop/go indicator light 54 on the base unit 30 goes from red to green illumination, indicating to the user to begin the game. In an exemplary embodiment, the countdown timer from the moment the "Play Now" button is selected to the moment play begins is five to six (5-6) seconds to allow the user to get positioned in the middle of the array of cones 100. As the game gets underway, the cone indicator lights 56 will randomly illuminate indicating to the user the cone 100 that is to be touched next, which is to be observed as indicated at step 184. More specifically, only one cone indicator light 56 will illuminate at a time, signaling to the user which associated cone 100 is to be touched, which is to trigger the user's reaction to the lights 56 by moving and striking the corresponding cone button 132 as indicated at step 186. For example, if the top left cone indicator light 56*a* on the base unit 30 lights up, the user should proceed as quickly as possible to the front left cone 100*a* and push or strike the front left cone button 132*a*, at which point the top left cone indicator light 56*a* on the base unit 30 would go off and a different one of the cone indicator lights 56 would illuminate instead, signaling to the user where to go next, all while the user maintains a live dribble of the basketball B in this example. This process would continue until the game ends as indicated at step 188, wherein if the game hasn't ended as by an associated timer or clock running out (i.e., the answer to the question is "NO"), the user would continue to observe the cone indicator lights 56 again at step 184 and strike the associated cone button 132 again at step 186 until the answer to the "Has game finished?" question is "YES" and thus no further cone indicator light 56 is illuminated and the central stop/go light 54 on the base unit 30 would illuminate red rather than green to visually indicate that the game has ended and the user should stop. Such a game may go on for thirty (30) seconds, for example, with the "challenge" being to see how many cones 100 can be touched in that time, which would be the user's score in this example. Those skilled in the art will appreciate that such a game and related dribble training system 20 according to aspects of the invention encourages "head up" dribbling to maintain visual connection with the base unit 30 and its cone indicator lights 56 as well as any gameplay timer running on the display of the linked electronic device D, all while keeping control of the ball B while dribbling with either hand so as to be able to quickly touch the cone buttons 132 on the left or right side of the array. Accordingly, dribbling skills will be honed as well as strength and conditioning, explosive forward and backward movements or "first step quickness," lateral movements, change of direction or "COD" movements more generally, and hand-eye coordination and reaction time, all while having fun. It will thus be appreciated that a number of benefits result from the configuration and use of a dribble training system 20 according to aspects of the present invention and that a variety of related system configurations and games and gameplay settings, including but not limited to gameplay level and duration, are possible in yielding such beneficial results, and that whether dribble training with a basketball B or not. Accordingly, once more, while an exemplary dribble training system 20 and method of its setup and use are herein shown and described, the invention is not so limited but may take numerous other forms and features without departing from the spirit and scope of the invention. With continued reference to FIG. 9, once the game ends and the answer to the "Has game finished?" question is "YES" at step 188, at step 190 the user would be able to review their score and any related previous scores for benchmarking or competition from the "Results Page" in the DribbleTEK software app running on the paired electronic device D. Accordingly, it will be appreciated that as part of the configuration of the app and the user's login credentials, a user or "gamer" profile would be created for that user to enter any pertinent information about themself and their goals and archive their games and training sessions for tracking their progress, more about which is said below.

Briefly, in addition to the visible indicators 54, 56 and related indicia on the display of the paired electronic device D, there may optionally also be audible indicators or feedback as projected from the one or more speakers 58 of the base unit 30, such as an audible countdown of the time left in a game and when the time runs out, as a "buzzer" sound like at the end of a quarter or half in a basketball game, or a "ding" or other sound when each cone button 132 is successfully hit and logged during gameplay. Also during gameplay, when the speaker(s) 58 is on or activated, the base unit 30 may audibly announce the score with each cone button 132 touch or in intervals of five (e.g., 5 or the fifth touch, 10 or the tenth touch, 15 or the fifteenth touch, etc.); in one exemplary embodiment, while the game time is counting down, such score announcements would cease during the last five seconds, when the remaining time may be audibly counted down as well (e.g., in a 30-second game, while the time is counting down after the 25th second the score would no longer be announced, though of course would still be kept). As noted above in connection with FIG. 2, the base unit 30 may be equipped with one or more speakers 58 for this purpose, which as with the lights 54, 56 would operate in conjunction with the overall base unit 30 and its electronics and processor/controller 70 (FIG. 4) as well as any related gameplay program sourced from the paired electronic device D and related app. Relatedly, the speaker 58 built into the base unit 30 may be a Bluetooth speaker with a separate Bluetooth address that is activated for pairing with the electronic device D such as a phone for playing audio over Bluetooth, such as even having enjoyable or inspiring music going during gameplay rather than any game-specific audible sounds. Such base unit speaker 58 may be paired with the electronic device D and DribbleTEK app as part of the overall pairing process described above or may be separately paired as desired. Such additional functional and entertainment aspects of the system 20 and the base unit 30 thereof may be linked to and configured within a particular user's "gamer" profile for enhanced experiences, including light and sound "shows" from the base unit 30, adding to the features and functionality of the system 20 that keeps users engaged.

In a bit more detail now about the exemplary DribbleTEK software app installed in an electronic device D employed with the dribble training system 20 as herein described according to aspects thereof, such app again enables pairing and operation with the base unit 30 and hence the cone units 100 paired therewith but also provides a variety of additional functionality and features that may be selectively employed in connection with the system 20, such as checking the base unit 30 battery 82 (FIG. 4) and/or the cone unit 100 battery 154 (FIG. 7) status/life and conducting other diagnostics of the system 20. At a high level, the DribbleTEK app facilitates a basketball online social media platform or community through which users (players, athletes, coaches, trainers, etc.) may interact from basically anywhere in the world, addressing basketball dribble training and other training needs while also forming a fun and competitive community of like-minded athletes. The DribbleTEK app fundamentally provides users with the opportunity to share scores and records, participate in live and recorded program activities, and increase exposure for a variety of marketing and engagement endeavors in the basketball and other sports communities through such features as social media "Live" and "Story" functionality. As such, the DribbleTEK App can provide functionality that naturally enables a user to socially connect with other users who are members of the DribbleTEK network or community and obviously share a common interest and may even be local to each other so as to meet up for in-person training sessions and games. As discussed above, the app as part of its facilitation of system 20 setup and gameplay can detect local WiFi networks and provide the user with the option to choose a WiFi network and similarly will be able to detect and facilitate connection to local devices via Bluetooth or the like. And again, when it comes to actual training sessions or gameplay, the DribbleTEK app facilitates not just the system 20 setup but gameplay and result logging, for the user's own benefit and/or for sharing via the app within the user's DribbleTEK network or community.

By way of further illustration regarding training sessions or gameplay employing the exemplary dribble training system 20 and related DribbleTEK software app as herein described according to aspects of the present invention, beyond the exemplary "Challenge The Standard" game or game set described above, there are a number of other game or training modules or sets for users to select from, again depending on the user's objectives, subscription level, and other factors, such as "Explosive Dribbling," "Playbook," "Defensive Prowess" and "True Basketball Conditioning," each of which is geared toward certain skills or abilities but all of which at some level will enhance the user's game and athletic ability with measurable results. For example, on the home screen associated with a particular game as displayed by the app on the electronic device D there will again be a "Play Now" button or the like for the user to be able to start a game and play right away as described above in connection with FIG. 9 and the exemplary "Challenge The Standard" game. There will also be an option on that same game home screen to adjust the time, 30 seconds being the default amount of time but there will be other run time options such as 60, 90 and 120 seconds that the user can choose from. The user will also be given the option of selecting what level (Beginner, Intermediate, Advanced) that they would like to play at and thus to make the games easier or harder depending on the level they choose. Other settings will also be available prior to and even during play such as a toggle switch for the user to be able to turn the sound on or off (the default setting being to have the sound on). There will also be an "Exit" button displayed as part of the app when running on the smartphone, tablet, or other electronic device D that when selected basically ends the action on the current screen and navigates back to the home screen, whereas a "Back" button would navigate to the previous screen. And again, by way of further illustration and not limitation, the user will also be able to navigate within the app to access the logged results of the user's games or sessions to track their progress and see how they are doing relative to their prior performance or goals as well as potentially against others. Particularly, the DribbleTEK app has the ability, among other things, to keep track of a user's high scores, average scores, and low scores, from the past day, week, month, six months, one year, and lifetime of the user's use of the app, for example. Those tracked scores can then be shown in a line graph depicting the user's progression or regression over time, with again such pictorial line graphs being relevant to potentially based on performance data over time periods such as the past week, month, six months, year, and lifetime use of the app. All such games will allow the user to compete against himself or herself or their friends and teammates in order to push them to be better and faster every day.

One general category of games and training programs as part of the system 20 and related software app again particularly have to do with dribble training, or playing a game or running through a drill or training session while dribbling to improve that basketball skill over time, it being appreciated that virtually all possible games as facilitated by the system 20 and app may be played with or without dribbling a basketball. Once more, aspects of the DribbleTEK system and method according to aspects of the present invention provide numerous advantages in use in creating and reinforcing good habits and techniques when dribbling, developing hand quickness and hand-eye coordination, and building stamina. And by virtue of the operation of the system 20 as herein shown and described, what is obtained are measurable or quantifiable data points for establishing baselines and benchmarks as a user progresses through use of the system 20 and playing various games. Specifically, the system 20 enables measurement of both hand speed and speed of dribble, first step quickness, change of direction (COD) ability, the time it takes for a user to travel between cones, and details or metrics such as triple threat position and movement (first step quickness) versus the use of a glide dribble or push dribble into a COD touch on a cone and quickness of the user's COD based off the distance between the cones and the amount of time it takes them between each of the consecutive touches. As such, users can track their average reaction time or hand quickness through each touch and keep track of their score in the app, so that they can see their progress over time and see their reaction time decrease and their hand speed increase. As an aside, during a replay mode for any game, including such dribbling games as described herein, one gameplay option allows a user to "run back" or play again not just the same game but the same randomized sequence of lights as the initial run, which can help a player compare more directly and improve over successive runs with the same drill (no variation or randomization) as well as provide an opportunity for a friend or teammate to execute or play the exact same light or cone sequence for comparison, with any such replayed games or runs not being taken into account for a user's high score or average score within their app. Such a re-play of any particular run within the "Challenge The Standard" game, for example, can be done as much as a user desires.

By way of further example in the dribbling games general category, once the user selects "Explosive Dribbling" from the "Game Play Options" home screen, the user will be taken to a page where they can select either of two games, "Downhill Challenge" or "Change of Direction ("COD") Madness." The user can choose which version they would like to play once they select the game from the "Explosive Dribbling" game options. If the "Downhill Challenge" game is selected, and really for all such dribbling drills and games, including the "Challenge The Standard" game, each drill will have an instructive video viewable from the DribbleTEK app of a player going over the type of dribble or dribble sequence that is to be done by the user in that particular game or drill. As an alternative trigger to initiate game play, instead or in addition to the "Play Now" button in the app, the user may press one of the cone buttons 132, such as cone button 132*e* associated with the left rear cone ("L3") in the exemplary six-cone array, in order to start the game or time. There will be a base unit 30 or device D countdown once the cone button 132*e* is touched to allow the user time to get ready to start the dribbling sequence. When the countdown completes and the game begins, the center stop/go indicator light 54 will shine green instead of red to show that the user should be doing the designated stationary dribbling series for that specific drill for a randomized amount of time (e.g., 10-15 seconds). So long as audio is not disabled, there will be an audio call-out to tell the user what dribbling drill or series the user is to be doing during that portion of the drill or game. And within that timeframe, the DribbleTEK app will then trigger one of two options on the light board or base unit 30, either the top left cone indicator light 56*a* ("L1") or the top right cone indicator light 56*b* ("R1") will show (which is random), and the user will then sprint with the ball B, still dribbling, to whichever cone 100*a* (left front) or 100*b* (right front) is indicated, and touch the respective cone button 132*a*, 132*b* as fast as possible. The time that it takes for the user to initially touch either cone 100*a* ("L1") or 100*b* ("R1") is recorded and averaged throughout the time the user is playing during that session, with the fastest time being noted. The DribbleTEK app will also be able to distinguish and accumulate scores of the players left side ("L1") touches versus their right side ("R1") touches, which will allow the user to see how fast they are going to their left on average compared to how fast they are going to their right on average. All the recorded times (average times for that session/day, fastest time that session/day) will be stored and will be able to be tracked against past times that week, month, year, lifetime of the app. Once the user has touched either of the front two cones 100*a* ("L1") or 100*b* ("R1"), the center stop/go indicator light 54 will flash red for five to ten (5-10) seconds, which will allow the user to get back to the left rear cone 100*e* ("L3") and, once back and ready, to touch the respective cone button 132*e*, whereby the light board 30 or app countdown on the device D display will again show and start the run again so the same dribble sequence will be initiated. The user will again have anywhere from ten to fifteen (10-15) seconds to do this dribble sequence before the middle left ("L2") or right ("R2") cone indicator light 56*c* or 56*d* is illuminated to once again trigger the dribble sprint to the appropriate cone 100*c* or 100*d*. In any such game, the user will be able to choose which dribble sequence they want to work on within the DribbleTEK app. There will also be a feature within the game to have the dribble sequences automatically rotated within the indicated level so that the user is working on a different dribble sequence each time they complete a left rear cone 100*e* ("L3") to a left front cone 100*a* ("L1") or right front cone 100*b* ("R1") touch. The different sequences will optionally be called out via the base unit speaker 58. Those different dribble sequences can be shown on the DribbleTEK app screen of the electronic device D right after the left front ("L1") button 132*a* or right front ("R1") button 132*b* is touched in the previous sequence, so that the user can go over to the device D to see what the DribbleTEK app will tell the user to do next. Then, once the user has the next sequence down, they can walk back to the rear left cone 100*e* ("L3") and press the respective button 132*e* to initiate that next dribbling sequence. At all times and with any game such as the "Downhill Challenge" described here, the user is able to determine when they want to end their session. The session starts once the user chooses a drill/sequence from the list within the respective level they have chosen (e.g., Beginner, Intermediate, Advanced) and ends once the user decides they no longer want to play or they want to play at a different level. Once the user makes this decision, the user will be able to click the "End Session" button at the bottom left corner of the app screen within the "Downhill Challenge" game in this example. When the "End Session" button is clicked, the user will be taken to a "Results" page as with other games, which will show the user their average times that have been recorded going left and right during that session. The "Results" page will also show the user's fastest time from that session going right and the fastest time from that session going left, with each such fastest time being stacked up against the user's top three fastest times within the recorded app history (with dates of those times next to the times recorded). Finally, there will again be the "Game Selection" page button within the "Results" page that will bring the user back to the "Game Play Options" page for whatever game is being played (e.g., "Downhill Challenge" or "Change of Direction ("COD") Madness" and any games within those sets or otherwise depending on what the user previously selected).

And if the "Change of Direction ("COD") Madness" game category is selected from "Explosive Dribbling" under "Game Play Options," the user will then be taken to a screen where they can choose which version they would like to play, such as "Normal" or "Cognitive Agility Training ("CAT") Color Challenge," and at what level they would like to play. This will give the user a way to pick which specific drill/sequence they want to play and which specific level they would like to compete at. If the "Cognitive Agility Training ("CAT") Color Challenge" game is selected, there will also be a "CAT Color Challenge Rules" button for the user to view the game rules or instructions. Once clicked, this button will bring the user to a page that explains the rules of the CAT Color Challenge within the COD Madness game. The exemplary rules are as follows: the base unit 30 will shine or illuminate the front left cone indicator light 56*a* ("L1") or the front right cone indicator light 56*b* ("R1") in many different colors (red, blue, yellow, orange, purple, white, etc.), and the user is not to go and touch the left front cone button 132*a* or right front cone button 132*b* until they see a green light pop up on either "L1" or "R1" (GREEN MEANS GO!). As part of the instructions, there may even be a simple video of a player going through this as a visual example for the user to reference and see what they are to do in the game. In a further exemplary aspect, approximately five to ten (5-10) seconds after game play initiation the light board or base unit 30 will begin showing different color RGB lights for the two possible cone options that the user would touch (either "L1" or "R1"), with the lights initially being all different colors showing for "L1" and "R1" (red, blue, yellow, orange, purple, white, etc.), with the timing of a green light popping up being about ten to fifteen (10-15) seconds after the start of the run. As mentioned elsewhere, the user will still have a visual stimulus for when the run is active (green illumination) or the run has completed or stopped (red illumination) via the central stop/go indicator light 54.

Another exemplary category of games selectable from the "Game Play Options" home screen is "Playbook," wherein the user will be taken to a page where they can select from among three representative and similar games, "Recall," "Memory" and "Patterns." These games are a fun way to increase a user's brain's capacity to remember game changing details and will push the user physically and mentally. The user will have the ability to pick how many touches they want to train for (e.g., 1-50), each different number of touches being the "Level" (so there are Levels 1-50 within the game). Once the user picks which level they wish to train for, then the light board or base unit 30 will first show the user the run via the cone indicator lights 56 (e.g., for Level 10, the base unit 30 will show the user a sequence of ten lights among the six cone indicator lights 56 with no cones 100 yet being touched)—the light board 30 will simply show the lights 56 that the run will consist of (which may look random, but are preset within the game). When displaying the sequence of cone indicator lights 56 for the run, each individual light 56 should stay lit for approximately one (1) second until it moves onto the next light 56 in the run. The user will be able to replay the show or sequence of the cone indicator lights 56 on the base unit 30 as many times as desired, though the amount of times that the user replays the light show will be recorded and displayed on the results page within the app for the game. When ready for the game, the user will then press "Play Now" and the system 20 will give them a sufficient amount of time to get in position, such as again five to six (5-6) seconds for example, and then the run will start on base unit 30 countdown (such as the countdown used for the "Challenge The Standard" game). No lights will show, but the user will have to go through the run and touch the appropriate cones 100, or more precisely the cone buttons 132, based off their recall of the light sequence that they watched the base unit 30 display previously (just prior to the run). As such, these "Playbook" games such as the "Recall" game explained above are effectively memory games, which is of course an important skill in basketball and other sports in addition to the physical skills and training accompanying such movements. If the user hits the wrong cone 100 then a negative audio indication will be played (e.g., shot clock violation or end of game "buzzer"), while if the User touches the correct cone 100 then a positive audio indication will be played (e.g., a "ding" or the sound of a chain net "swish"). When the user has unsuccessfully completed a level there will be an audio "punishment" (e.g., the same shot clock violation or end of game "buzzer" sound). Whereas, once the user has successfully completed the level there will be an audio and/or lightshow reward from the base unit 30 in conjunction with the paired smartphone or other electronic device D and associated software app as herein described. Then the user can choose to move up a level if desired or they can choose to stay at that level and just simply pick a different run. In either case, in connection with the just attempted game or run, the results screen will show how many correct touches were made during that run and incorrect touches as appropriate and also how many seconds it took to accomplish those touches (i.e., how fast the user was going). Again, the results screen will also show how many times the user replayed the light show prior to playing the actual game and the top three high scores in that particular user's (player or "gamer" profile) history for that particular level of the Recall or related game and whether or not the last run if successful made it into the top three high scores. A user can choose to replay any particular run within the Recall game as much as they want. The "Memory" and "Patterns" games under the "Playbook" set of games are similar to the "Recall" game. Except that the "Memory" game may set a minimum and/or maximum time for game play, such as a minimum time of ten (10) seconds and increased by increments of five (5) seconds up to ninety (90) seconds, with the time of each run being recorded, and may include for example twenty (20) options for different runs pre-loaded with up to fifty (50) touches. And for the "Patterns" game, there may be three basic levels, such as beginner, intermediate, and advanced, with three (3) patterns per level or nine (9) total patterns uploaded and playable, with the user having the option of 30, 60, 90 and 120 second runs for each of the nine run options and the related time displayed on the screen of the electronic device D as counting down on the runs from 30, 60, 90, 120 seconds to 0. In any such "Playbook" games, the number of correct touches within the given amount of time during the run will be added up and recorded as part of the "Results" displayed within the DribbleTEK app. In terms of other related customization or features, a user can select a light sequence pattern of choice from visual representations of patterns as part of the game selection and can mark their favorite patterns with the use of a star or symbol for ease of access by the user. At any point during new game play or re-play, the user will be presented the option of going through a run with the lights 56 showing up on the light board or base unit 30 or to go through the run without lights 56 (making the run much more challenging)—this function will be simply through a toggle switch for lights on/off (the default setting being to have the lights on).

A further exemplary category of games or drills selectable from the "Game Play Options" home screen is "Defensive Prowess," wherein particular drills and games will take the user through movements, still employing the light board or base unit 30 and the paired cone units 100, that are particularly helpful or relevant to playing defense in the game of basketball, which in this example of course would not involve dribbling a basketball. Once selected from the "Game Play Options," there will be a "How to Play" button that when selected will go over all the rules of the "Defensive Prowess" game. On this page there will be a short video that shows how to play "Defensive Prowess." There will also be the rules written out and a visual representation of the scenario via a picture of the standard setup with arrows pointing to the type of touches that are being discussed. The parameters for the "Defensive Prowess" game are as follows. Lateral side-to-side touches such as from the middle left cone 100*c* ("L2") to the middle right cone 100*d* ("R2") and vice versa will be completed with a defensive slide action. Diagonal forward touches from the left rear cone 100*e* ("L3") to the right front cone 100*b* ("R1") or the right rear cone 100*f* ("R3") to the left front cone 100*a* ("L1") will be completed via close-out. Diagonal backwards touches from the right front cone 100*b* ("R1") to the left rear cone 100*e* ("L3") or from the left front cone 100*a* ("L1") to the right rear cone 100*f* ("R3") will be completed via sprint-step. Shorter diagonal forward touches from the right rear cone 100*f* ("R3") to the left middle cone 100*c* ("L2"), from the right middle cone 100*d* ("R2") to the left front cone 100*a* ("L1"), from the left rear cone 100*e* ("L3") to the right middle cone 100*d* ("R2"), and from the left middle cone 100*c* ("L2") to the right front cone 100*b* ("R1") will be completed via defensive slides. And shorter diagonal backwards touches from the right front cone 100*b* ("R1") to the left middle cone 100*c* ("L2"), from the right middle cone 100*d* ("R2") to the left rear cone 100*e* ("L3"), from the left front cone 100*a* ("L1") to the right middle cone 100*d* ("R2"), and from the left middle cone 100*c* ("L2") to the right rear cone 100*f* ("R3") will be completed via drop-step slides. In actual "Defensive Prowess" gameplay, from the relevant "Game Play Options" screen, there will be options for a "Patterned Run" that the user may select to be taken to the "Patterns Selection" page or a "Dynamic Run" for the user to be taken directly to play one of twenty (1-20) dynamic runs that is chosen for them by the DribbleTEK app at random—in the exemplary game, each run will have up to one hundred (100) touches. As with other games, there will also be an option on that screen to adjust the time of the run, 30 seconds being the default amount of time for the run) with other run time options being 60, 90 and 120 seconds that the user can choose from. And also as with the other games, there will be a toggle switch for the user to be able to turn the sound on or off (the default setting being to have the sound on). In the "Defensive Prowess" game, all patterns, whether selected by the user or selected by the app dynamically, will only offer lateral touches, meaning moving from a cone on the left side of the setup to a cone on the right or vice versa, with the most basic pattern being simply side-to-side (e.g., from the middle right cone 100*d* ("R2") to the middle left cone 100*c* ("L2") and vice versa). Again, the user will not have a basketball in hand during this game and will simply defensive slide from cone to cone on lateral touches and shorter diagonal forward touches, will employ sprint-step or drop-step slides on diagonal backwards touches, and will close-out on full diagonal forward touches, in all cases staying low and using proper positive step footwork. With the different actions needed to be taken depending on where the next cone touch lies, the speaker 58 within the light board will be announcing what actions are to be taken by the user (e.g., slide, drop-step slide, sprint-step, close-out). The light board or base unit 30 may still also illuminate the appropriate cone indicator light 56 to which the user is heading at any point during gameplay (e.g., the top right cone indicator light 56*b* would illuminate if the user is engaged in a diagonal forward touch using close-out technique from the left rear cone 100*e* ("L3") to the right front cone 100*b* ("R1") until the right front cone button 132*b* is touched). And as with other games as described herein, in addition to any audible countdown or other indicators, the user will have a visual stimulus for when the run is active (green illumination) and when the run has completed or stopped (red illumination) via the central stop/go indicator light 54 on the light board or base unit 30. Every time the user completes a run and chooses the "Play Next" button from the "Game Results" screen, they will be given a different run out of the twenty runs preprogrammed in the DribbleTEK, still with the user's selections related to run time, etc. Users will improve their stamina and speed while in a defensive stance and will also improve on their positive step footwork within the defensive stance as well and will thus be able to make and track their improvements in areas all related to becoming a better defender in game situations.

And finally, a still further exemplary category of games or drills selectable from the "Game Play Options" home screen of the DribbleTEK app is "True Basketball Conditioning," wherein as the name implies the user would engage in various games or drills that are focused on or particularly relate to actual conditioning or developing strength and stamina. Many of such conditioning movements are analogous to those in other games, here done with or without dribbling a basketball, including the lateral or side-to-side and diagonal cone-to-cone movements explained above in connection with the "Defensive Prowess" game. In addition, the "True Basketball Conditioning" game will include straight-line or same-side forward touches via sprinting or "going downhill," such as from the left rear cone 100*e* ("L3") to either the left middle cone 100*c* ("L2") or the left front cone 100*a* ("L1") or from the right rear cone 100*f* ("R3") to either the right middle cone 100*d* ("R2") or the right front cone 100*b* ("R1"), or backward touches via rapid back-peddling, such as from the left front cone 100*a* ("L1") to either the left middle cone 100*c* ("L2") or the left rear cone 100*e* ("L3") or from the right front cone 100*b* ("R1") to either the right middle cone 100*d* ("R2") or the right rear cone 100*f* ("R3"). As in other games, once more, the various movements will be indicated to the user via audible announcements via the speaker 58 (e.g., "Sprint!" where the touches involve moving straight forward, "Back-pedal!" where the touches involve moving straight backward, "Slide!" where the touches involve moving laterally side-to-side, "Sprint-Step!" where the touches involve moving forward diagonally, or "Drop-Step!" where the touches involve moving backward diagonally) and/or selectively illuminated cone indicator lights 56 on the light board or base unit 30 in conjunction with the paired electronic device D running the DribbleTEK app on which the user has made his or her selections to begin gameplay, and the central stop/go indicator light 54 on the base unit 30 will again indicate visually whether the run is active (green illumination) or has completed or stopped (red illumination). Other exercises not directly involving the cones 100, other than to touch a cone button 132 when the exercise is completed, can include pushups, planks, tuck jumps, etc. Here, once the workout portion of the game starts, the DribbleTEK app will tell the user via the speaker 58 in the base unit 30 what specific workout or exercise they are to do, during which time the center stop/go indicator light 54 on the base unit 30 will flash green until the workout portion is over and the light 54 will then return to steady green illumination, at which point the time for touches starts back up again with an audio cue telling the user to get back to the touches portion, and the user will finish (e.g., the last 10-20 seconds) with the sprints, back-pedals, slides, and drop-steps and sprint-steps with the touches as explained above. There may be twenty-five (25) different randomized runs of up to two hundred (200) touches or exercises per run, with user-selected time intervals such as 30, 45, 60, 90 and 120 seconds per run, and with the rules or game description again being available from the "Game Play Options" screen once "True Basketball Conditioning" is selected. Those skilled in the art will appreciate that incorporating the "True Basketball Conditioning" game into both individual and team training workouts will give them a more fun and competitive way to train for the game and will get players in top basketball shape.

Once again, with all possible games as facilitated by the dribble training system 20 and related DribbleTEK app according to aspects of the present invention, including those games described herein, play may be with or without dribbling a basketball depending on the user's objectives. Those skilled in the art will appreciate that regardless, aspects of the DribbleTEK system and method provide numerous advantages in use in creating and reinforcing good habits and techniques when dribbling, developing hand quickness and hand-eye coordination and foot speed with proper offensive or defensive posture, and building related strength and stamina. And with all such games, the DribbleTEK system and app will show the user the results of their past game and previous high and low scores and provide options for game re-play or saving preferences for later training sessions, benchmarking, sharing results, etc. Particularly, within the networked community of subscribers, users can track stats and measure their performance stats against others in the community, share results and ideas, enter contests or tournaments, etc. Indeed, this gives a user the ability to see where they rank among basketball players their age all around the world, and by providing their zip Code, users will be able to benchmark their scores with their local community. The historical data thus logged via the system and app is incredibly valuable and helpful to refer back to and see what areas of improvement are needed as well as what improvement has already been achieved, allowing the user to track their progress over a given amount of time with real dates to look back at. Accordingly, as facilitated by a training system and method according to aspects of the present invention, a user can correct specific basketball weaknesses by engaging in the relevant or most helpful game or pattern, with the DribbleTEK app even able to provide recommended workouts based on the progress and goals of the user. All such data and interaction and the user's game experience and progress would be stored in the system or app assuming sufficient data storage. There is even contemplated an on-the-go portion of gameplay within the app that can be done by finger or thumb touches on the electronic device D rather than physical cones as a way for users to develop or engage in Cognitive Agility Training ("CAT") and reaction time training without needing to physically train, giving users a way to improve their ability to react to in-game situations and make correct reads when faced with a live-game scenario. Once again, those skilled in the art will appreciate that a wide variety of systems and methods, or hardware and software, according to aspects of the present invention are possible without departing from its spirit and scope, such that the exemplary equipment and methods of its use, including setup and various gameplay options, are to be understood as illustrative and non-limiting as to the features and functionality of the invention.

In closing, regarding the exemplary embodiments of the present invention as shown and described herein, it will be appreciated that a comprehensive, versatile, and easy to use dribble training system and method of use is disclosed wherein a base unit is wirelessly paired with multiple operable cone units and with an electronic device running a related software app for facilitating a variety of drills and games for improving a user's dribbling skills, hand quickness and hand-eye coordination, foot speed with proper offensive or defensive posture, and related mental and physical strength and stamina. Because the principles of the invention may be practiced in a number of configurations beyond those shown and described, it is to be understood that the invention is not in any way limited by the exemplary embodiments, but is generally able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

The methods as described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor (s) believe that the claimed subject matter is the invention.

What is claimed is:

1. A dribble training system comprising:

a base unit having a processor in electrical communication with a decoder, with a base unit encoder, and with a receiver, the decoder configured to receive a two-digit base unit group address selection from the base unit encoder and to receive data from the receiver and to send the base unit group address selection and the data to the processor, the base unit further having a plurality of cone indicator lights in electrical communication with the processor; and a plurality of cone units each having a cone unit encoder in electrical communication with a first encoder, with a second encoder, with an activate button switch, and with a transmitter, the cone unit encoder configured to receive a two-digit cone unit group address selection from the first encoder and to receive a one-digit cone identifier from the second encoder and to transmit the cone unit group address selection and the cone identifier to the base unit via the transmitter and the receiver, the data sent by the receiver to the processor comprising the cone unit group address selection and the cone identifier, each cone unit further having a cone body and a button operably installed on the cone body and operably engaged with the activate button switch, wherein:

the base unit group address selection and the cone unit group address selection in each of the plurality of cone units correspond to ensure that the base unit and the plurality of cone units are wirelessly paired for communication from each transmitter to the receiver;

each cone identifier is unique to a specific cone unit from among the plurality of cone units to ensure that each cone unit is uniquely identifiable by the base unit; and the plurality of cone indicator lights on the base unit correspond with the plurality of cone units, whereby each cone indicator light from among the plurality of cone indicator lights represents a specific cone unit from among the plurality of cone units, and further whereby selective illumination of a specific cone indicator light under the control of the processor followed by activation of a specific activate button switch by touching the operably engaged button of the specific cone unit corresponding to the illuminated specific cone indicator light causes wireless transmission from the specific cone unit to the base unit via the transmitter and the receiver of an activation signal corresponding to the activated specific activate button switch, the data sent from the receiver to the processor further comprising the activation signal and resulting in cessation of the illumination of the specific cone indicator light under the control of the processor.

2. The system of claim 1 wherein:

the base unit further has a housing containing the processor, the decoder, the base unit encoder, and the receiver, the housing having a front wall; and the plurality of cone indicator lights are positioned on the front wall so as to be visible outside of the housing.

3. The system of claim 2 wherein the base unit further has a speaker in electrical communication with the processor and contained within the housing and configured to produce audible sounds associated with gameplay of the system.

4. The system of claim 2 wherein the housing further comprises a receptacle configured for receipt of an electronic device running a software application, the electronic device being selectively pairable with the base unit for facilitating gameplay.

5. The system of claim 4 wherein the housing further comprises a selectively extendable and retractable arm adjacent to the receptacle, the arm configured to cooperate with the receptacle in securing the electronic device on the housing.

6. The system of claim 2 further comprising a stand, wherein the housing further comprises a mounting hole formed in a bottom wall of the housing for selectively mounting the base unit on the stand.

7. The system of claim 2 wherein the base unit further has a stop/go indicator light in electrical communication with the processor and associated with gameplay of the system and configured to illuminate green when a game is underway and red when a game is ended, the stop/go indicator light being positioned on the front wall adjacent to the plurality of cone indicator lights so as to be visible outside of the housing.

8. The system of claim 7 comprising six cone units, wherein the base unit comprises six cone indicator lights, a first set of three cone indicator lights along the left portion of the front wall and a second set of three cone indicator lights along the right portion of the front wall with the stop/go indicator light between the first and second sets of cone indicator lights.

9. The system of claim 1 wherein each cone unit further has a button module comprising the activate button switch and the operably engaged button configured for use during gameplay, the button module being selectively installed within an opening at an upper end of the cone body.

10. The system of claim 9 wherein each cone unit further comprises an electronics module in electrical communication with the button module, the electronics module containing the cone unit encoder, the first encoder, the second encoder, and the transmitter, the electronics module being selectively installed within the cone body adjacent to the button module.

11. The system of claim 10 wherein for each cone unit both the button module and the electronics module are selectively removable from the cone body, whereby the cone bodies associated with the plurality of cone units may be more readily stacked for storage and transport and the button modules and electronics modules associated with the plurality of cone units may be more readily serviced and/or charged.

12. A method of dribble training employing a dribble training system, the method comprising the steps of:

positioning a base unit of the dribble training system spatially, the base unit having a processor in electrical communication with a decoder, with a base unit encoder, and with a receiver, the decoder configured to receive a two-digit base unit group address selection from the base unit encoder and to receive data from the receiver and to send the base unit group address selection and the data to the processor, the base unit further having a plurality of cone indicator lights in electrical communication with the processor;

positioning a plurality of cone units of the dribble training system spatially in proximity to the base unit, each cone unit having a cone unit encoder in electrical communication with a first encoder, with a second encoder, with an activate button switch, and with a transmitter, the cone unit encoder configured to receive a two-digit cone unit group address selection from the first encoder and to receive a one-digit cone identifier from the second encoder and to transmit the cone unit group address selection and the cone identifier to the base unit via the transmitter and the receiver, the data sent by the receiver to the processor comprising the cone unit group address selection and the cone identifier, each cone unit further having a cone body and a button operably installed on the cone body and operably engaged with the activate button switch;

wirelessly pairing the base unit with the plurality of cone units as by setting the base unit group address selection and the cone unit group address selection to be corresponding and further by setting the cone identifier unique to each cone unit in the plurality of cone units, wherein the base unit group address selection and the cone unit group address selection in each of the plurality of cone units correspond to ensure that the base unit and the plurality of cone units are wirelessly paired for communication from each transmitter to the receiver, and further wherein each cone identifier is unique to a specific cone unit from among the plurality of cone units to ensure that each cone unit is uniquely identifiable by the base unit;

initiating gameplay of the system;

observing illumination of a specific cone indicator light; and activating the specific activate button switch by touching the respective engaged button of the specific cone unit corresponding to the illuminated specific cone indicator light, wherein the plurality of cone indicator lights on the base unit correspond with the plurality of cone units, whereby each cone indicator light from among the plurality of cone indicator lights represents a specific cone unit from among the plurality of cone units, and further whereby selective illumination of a specific cone indicator light under the control of the processor followed by activation of a specific activate button switch by touching the operably engaged button of the specific cone unit corresponding to the illuminated specific cone indicator light causes wireless transmission from the specific cone unit to the base unit via the transmitter and the receiver of an activation signal corresponding to the activated specific activate button switch, the data sent from the receiver to the processor further comprising the activation signal and resulting in cessation of the illumination of the specific cone indicator light under the control of the processor.

13. The method of claim 12 wherein the step of positioning the base unit spatially comprises mounting the base unit on a stand in a vertical orientation, with a front wall of a housing of the base unit having the plurality of cone indicator lights facing the plurality of cone units.

14. The method of claim 12 further comprising the step of pairing an electronic device running a software application with the base unit, the electronic device and related software application configured to facilitate gameplay in conjunction with the base unit and the plurality of cone units.

15. The method of claim 14 further comprising the steps of selecting a game and game settings including game level and game duration and initiating gameplay via the software application.

16. The method of claim 15 wherein the step of selecting a game and game settings further comprises selecting from among games stored in the software application directed to dribble training, defensive training, conditioning training, and cognitive training.

17. The method of claim 15 further comprising the step of storing and sharing over a network gameplay results via the software application.

18. The method of claim 17 wherein the gameplay results are archived via the software application for benchmarking and tracking progress with particular games over particular periods of time.

19. The method of claim 14 wherein the step of positioning the plurality of cone units spatially in proximity to the base unit comprises configuring the software application with a geospatial measurement function and running the software application to geolocate each of the cone units among the plurality of cone units.

20. The method of claim 12 wherein the steps of observing illumination of a specific cone indicator light and activating the specific activate button switch by touching the respective engaged button of the specific cone unit corresponding to the illuminated specific cone indicator light are repeated during gameplay for a set period of time, with such successively illuminated cone indicator lights being either programmed or random based on the gameplay initiated.

* * * * *